US010405723B2

(12) United States Patent
Ickes et al.

(10) Patent No.: US 10,405,723 B2
(45) Date of Patent: Sep. 10, 2019

(54) SURFACE MAINTENANCE MACHINE

(71) Applicant: Tennant Company, Minneapolis, MN (US)

(72) Inventors: John C. Ickes, Rockford, MN (US); Martin L. Dickrell, Golden Valley, MN (US); Ronald W. Lehman, Maple Grove, MN (US); Kyle D. Sedam, Rogers, MN (US); Jacob L. Stock, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 336 days.

(21) Appl. No.: 15/374,324

(22) Filed: Dec. 9, 2016

(65) Prior Publication Data

US 2017/0164805 A1 Jun. 15, 2017

Related U.S. Application Data

(60) Provisional application No. 62/360,661, filed on Jul. 11, 2016, provisional application No. 62/265,063, filed on Dec. 9, 2015.

(51) Int. Cl.
*A47L 11/40* (2006.01)
*A47L 11/10* (2006.01)
(Continued)

(52) U.S. Cl.
CPC ..... *A47L 11/4061* (2013.01); *A47L 11/10* (2013.01); *A47L 11/162* (2013.01); *A47L 11/24* (2013.01);
(Continued)

(58) Field of Classification Search
CPC .... A47L 11/4061; A47L 11/10; A47L 11/162; A47L 11/24; A47L 11/305;
(Continued)

(56) References Cited

U.S. PATENT DOCUMENTS 4,667,364 A * 5/1987 Meili ..... A47L 11/293 15/319
5,785,453 A 7/1998 Marty et al.
(Continued)

FOREIGN PATENT DOCUMENTS

CN 202739920 U 2/2013
CN 202981889 U 6/2013
(Continued)

OTHER PUBLICATIONS

International Patent Application No. PCT/US2016/065834, International Search Report and Written Opinion dated May 4, 2017, 19 pages.
(Continued)

*Primary Examiner* — Shay Karls
(74) *Attorney, Agent, or Firm* — Fredrikson & Byron, P.A.

(57) ABSTRACT

A surface maintenance machine comprising a body having a forward section, a middle section and a rearward section, wherein the forward section is positioned to the front of a transverse centerline of the machine, the middle section is generally centered on the transverse centerline and a rearward section positioned to the rear of the transverse centerline. A storage chamber can be defined in the middle section and enclosed by a front wall, a rear wall, lateral walls, a generally planar top surface, and a generally planar lower surface, such that the storage chamber is generally isolated from components of the surface maintenance machine. The storage chamber can have a storage chamber bottom surface with or below a top surface of at least one battery positioned in the forward section.

22 Claims, 19 Drawing Sheets

(51) Int. Cl.
*A47L 11/24* (2006.01)
*A47L 11/162* (2006.01)
*A47L 11/30* (2006.01)

(52) U.S. Cl.
CPC ..... *A47L 11/305* (2013.01); *A47L 11/4008* (2013.01); *A47L 11/4016* (2013.01); *A47L 11/4038* (2013.01); *A47L 11/4044* (2013.01); *A47L 11/4055* (2013.01); *A47L 11/4066* (2013.01); *A47L 11/4072* (2013.01); *A47L 11/4083* (2013.01); *A47L 11/4091* (2013.01)

(58) Field of Classification Search
CPC ..... A47L 11/4008; A47L 11/4016; A47L 11/4038; A47L 11/4044
See application file for complete search history.

(56) References Cited

U.S. PATENT DOCUMENTS

| | | | |
|---|---|---|---|
| 5,947,490 | A | 9/1999 | Munnoch et al. |
| 6,842,940 | B2 | 1/2005 | Christopher et al. |
| 7,533,435 | B2 | 5/2009 | Pedlar et al. |
| 8,234,748 | B2 | 8/2012 | Mayer |
| 8,245,345 | B2 | 8/2012 | Pedlar et al. |
| 8,302,240 | B2 | 11/2012 | Tucker et al. |
| 8,397,333 | B2 | 3/2013 | Tucker et al. |
| 8,438,685 | B2 | 5/2013 | Pedlar et al. |
| 8,528,142 | B1 | 9/2013 | Pedlar et al. |
| 8,561,256 | B2 | 10/2013 | Mayer |
| 8,584,294 | B2 | 11/2013 | Loring |
| 8,863,351 | B2 | 10/2014 | Mayer |
| 8,887,340 | B2 | 11/2014 | Pedlar et al. |
| 9,015,887 | B1 | 4/2015 | Pedlar et al. |
| 9,049,975 | B2 | 6/2015 | Shinler |
| 9,124,544 | B2 | 9/2015 | Muller et al. |
| 9,192,276 | B2 | 11/2015 | Pedlar et al. |
| 9,451,861 | B2 | 9/2016 | Pedlar et al. |
| 9,510,721 | B2 | 12/2016 | Pedlar et al. |
| 9,730,566 | B2 | 8/2017 | Pedlar et al. |
| 9,757,005 | B2 | 9/2017 | Pedlar et al. |
| 2004/0031629 | A1 | 2/2004 | Walker |
| 2005/0223514 | A1 | 10/2005 | Stuchlik et al. |
| 2010/0291843 | A1 | 11/2010 | Strickland |
| 2012/0096671 | A1 | 4/2012 | Venard et al. |
| 2014/0173864 | A1 | 6/2014 | Hamm |
| 2015/0265123 | A1* | 9/2015 | Chen ..... A47L 11/4011 340/679 |
| 2017/0340183 | A1 | 11/2017 | Pedlar et al. |
| 2018/0110390 | A1 | 4/2018 | Pedlar et al. |

FOREIGN PATENT DOCUMENTS

| | | | |
|---|---|---|---|
| CN | 103505155 | A | 1/2014 |
| EP | 2011426 | A1 | 1/2009 |

OTHER PUBLICATIONS

Partial International Search Report for PCT/US2016/065834, 4 pages, dated Mar. 8, 2017.

* cited by examiner

Section 6-6

SURFACE MAINTENANCE MACHINE

RELATED APPLICATIONS

This application claims the benefit of U.S. Provisional Patent Application No. 62/265,063 filed Dec. 9, 2015, and U.S. Provisional Patent Application No. 62/360,661, filed Jul. 11, 2016, the entire contents of each of which are incorporated herein by reference.

BACKGROUND

Surface maintenance machines for relatively large floor areas, for example, of commercial, industrial, public or institutional spaces, are typically integrated with an operator-driven vehicle. These machines can be a floor scrubbing machine or a floor sweeping machine. Other machines, such as polishing, burnishing or outdoor litter collecting machines can also perform other surface maintenance operations such as cleaning (e.g., sweeping, scrubbing, etc.) polishing, burnishing, buffing, stripping and the like on surfaces such as floors, hallways, etc. of buildings, roads, pavements, sidewalks and the like.

Some such surface maintenance machines are commercially available "micro" rider machines, allowing an operator to stand on a platform. Some of these machines have a centrally located front wheel and two rear wheels, with the operator platform inset between the rear wheels. In such machines, a common way to steer and propel a wheel (typically the centrally located front wheel) is by using a wheel motor rotatable by means of a steering linkage. In such machines, the location of the center of gravity should be accounted for to provide stability during normal vehicle operation (e.g., braking during turning).

Moreover, known mechanisms to steer and propel three-wheeled machines, such as using independently driven wheels (e.g., differential steering), can often lead to higher complexity. Prior three wheeled machines with two front wheels and one rear wheel have used steerable rear wheels which may lead to rear swing, which may cause portions of the vehicle to move in a direction opposite to the direction of turn. Rear swing may be undesirable when maneuvering next to objects (walls, curbs, buildings, people, etc.). Another known mechanism for three-wheeled vehicles includes a steerable single front wheel and two rear wheels propelled by a transaxle. This mechanism does not allow for a zero turn (e.g., a turn of zero turning radius). Other ways of steering a three-wheeled machine with two front wheels and a single rear wheel machine include providing a steering linkage connecting the two front wheels. As the steering linkage does permit sufficient steering rotation, such a mechanism would not permit a zero turn.

SUMMARY

In one aspect, this disclosure is directed to a surface maintenance machine comprising a body having a forward section, a middle section and a rearward section, wherein the forward section is positioned to the front of a transverse centerline of the machine, the middle section is generally centered on the transverse centerline and a rearward section positioned to the rear of the transverse centerline. The body may include a generally planar top surface positioned above a center plane of the body and generally parallel thereto and a generally planar lower surface positioned below the center plane of the body and generally parallel thereto. A storage chamber can be defined in the middle section and enclosed by a front wall, a rear wall, lateral walls, the generally planar top surface, and the generally planar lower surface, such that the storage chamber is generally isolated from components of the surface maintenance machine. The front wall of the storage chamber may abut the forward section and the rear wall of the storage chamber may abut the rearward section. The storage chamber can be generally hollow to store one or more surface maintenance tools and/or supplies. The machine may have two front wheels positioned to the front of a transverse centerline of the machine when the machine is moving in a forward direction, and at least one rear wheel positioned to the rear of the transverse centerline.

In another aspect, the surface maintenance machine comprises one or more batteries for propelling and/or providing on-board power to the machine positioned in the forward section. The machine may also include a solution tank for supplying a cleaning solution to a floor surface on which the machine travels and a recovery tank for collecting waste from a floor surface on which the machine travels. At least one of the solution tank and recovery tank can be positioned in the forward section. The storage chamber can have a storage chamber bottom surface with or below a top surface of at least one battery positioned in the forward section.

The details of one or more examples are set forth in the accompanying drawings and the description below. Other features, objects, and advantages will be apparent from the description and drawings, and from the claims.

DETAILED DESCRIPTION

Figure 1A:
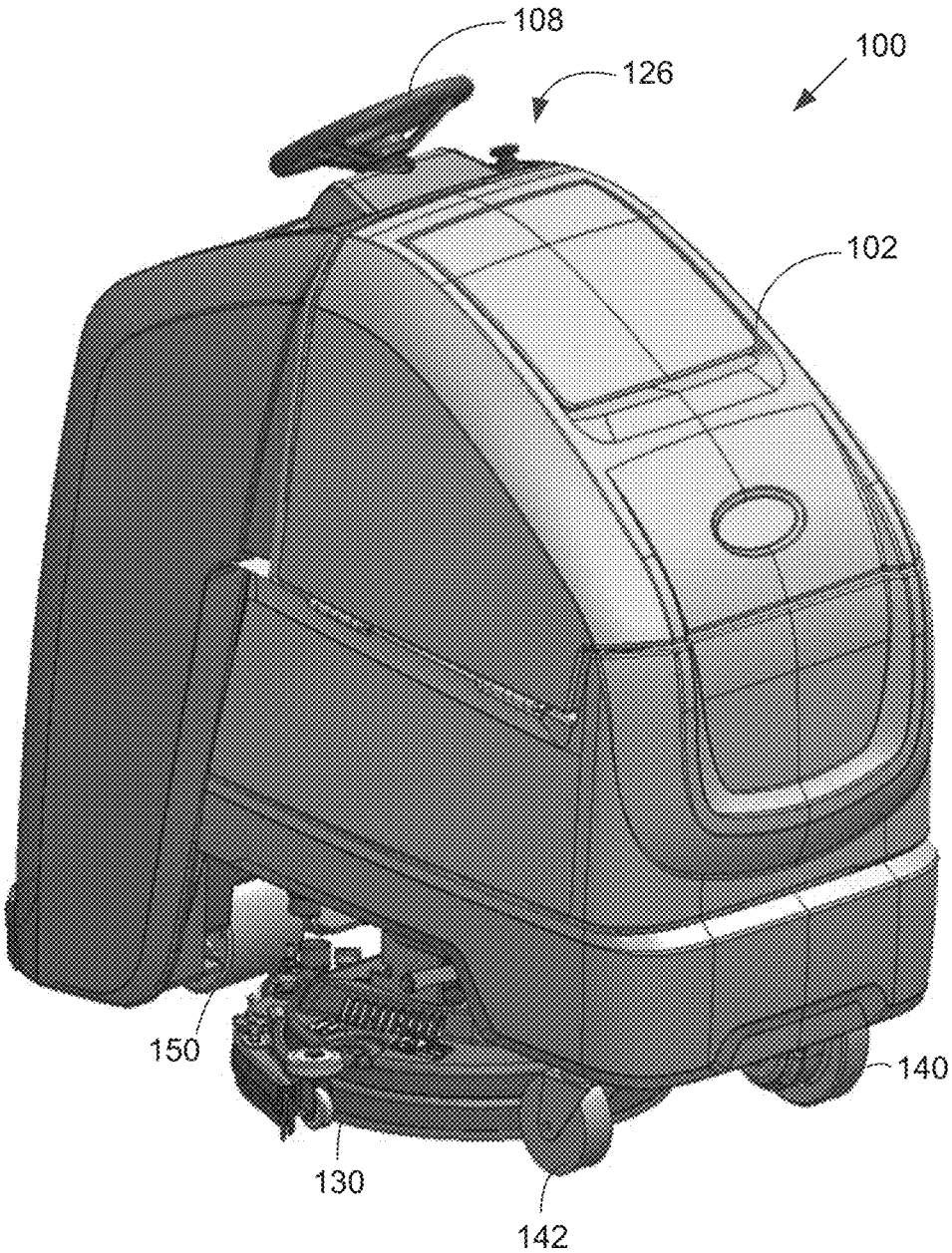
FIG. 1A is a perspective view of a surface maintenance machine according to an embodiment.
Figure 1B:
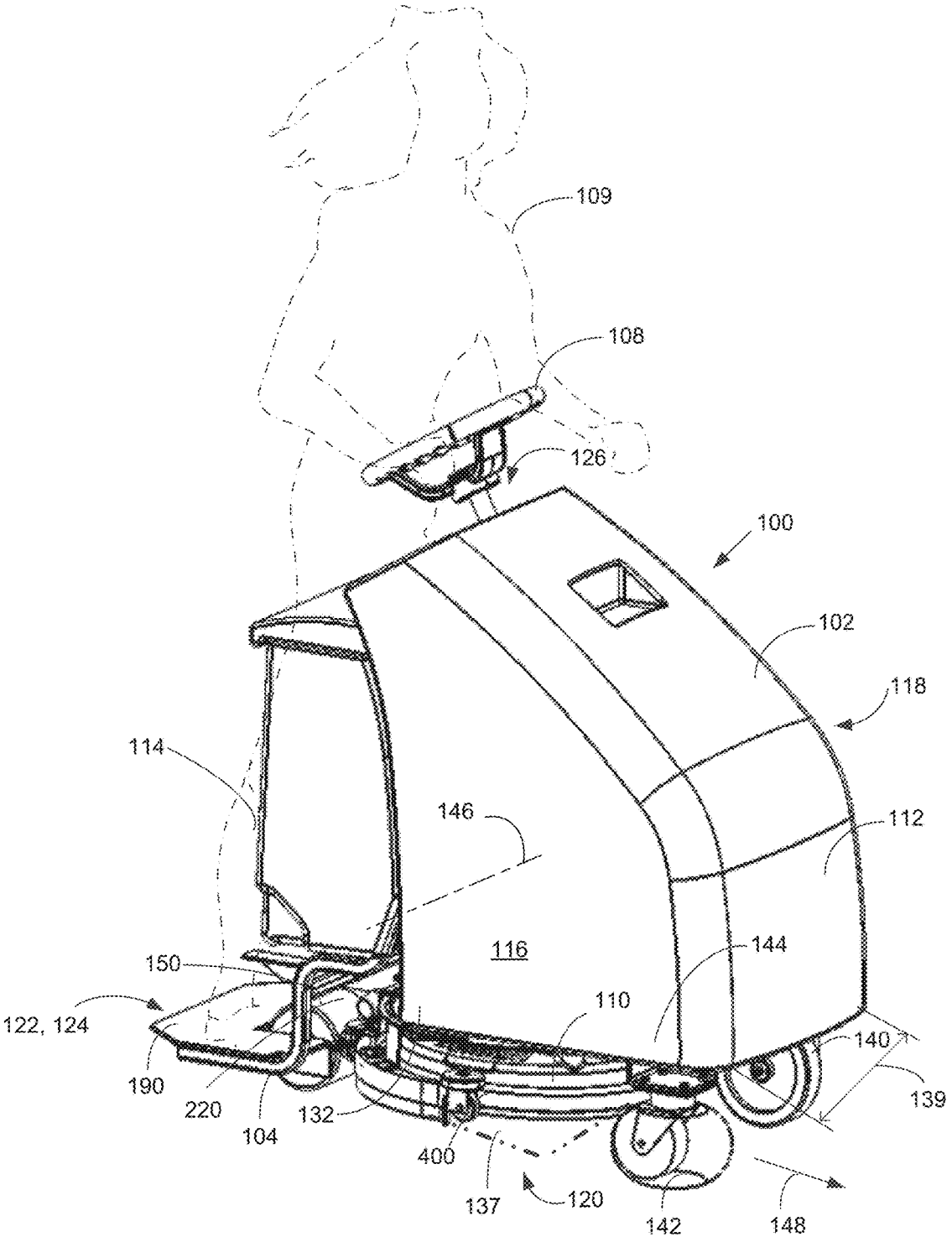
FIG. 1B is a perspective view of the surface maintenance machine of FIG. 1A with some body panels removed to illustrate internal detail.

FIG. 1A is a perspective view of an exemplary surface maintenance machine 100. FIG. 1B illustrates the surface maintenance machine 100 with some body panels removed for clarity. In the illustrated embodiment shown in FIG. 1B, the surface maintenance machine 100 is s a ride-on machine 100. The surface maintenance machine 100 can perform maintenance tasks such as sweeping, scrubbing, polishing (burnishing) a surface. The surface can be a floor surface, pavement, road surface and the like. Embodiments of the surface maintenance machine 100 include components that are supported on a mobile body 102. As best seen in FIG. 1B, the mobile body 102 comprises a frame 104 supported on wheels for travel over a surface, on which a surface maintenance operation is to be performed. The mobile body 102 may include operator controls (not shown) and a steering control such as a steering wheel 108 such that an operator 109 can turn the steering wheel 108 and control the speed of the machine 100 without having to remove the operator's hands from the steering wheel 108 using means well-known in the art. The machine can perform maintenance on a maintenance path which can have an area corresponding to an envelope defined by the front surface 112, back surface 114 and two lateral surfaces 116 and 118 of the machine 100 as the machine travels on a surface 120.

The surface maintenance machine 100 can be powered by an on-board power source such as one or more batteries or an internal combustion engine (not shown). The power source can be proximate the front of the surface maintenance machine 100, or it may instead be located elsewhere, such as within the interior of the surface maintenance machine 100, supported within the frame 104, and/or proximate the rear of the surface maintenance machine 100. Alternatively, the surface maintenance machine 100 can be powered by an external electrical source (e.g., a power generator) via an electrical outlet or a fuel cell. The interior of the surface maintenance machine 100 can include electrical connections (not shown) for transmission and control of various components.

While not shown in detail in FIG. 1B, the surface maintenance machine 100 includes a maintenance head assembly 400. The maintenance head assembly 400 houses one or more surface maintenance tools such as scrub brushes, sweeping brushes, and polishing, stripping or burnishing pads, and tools for extracting (e.g., dry or wet vacuum tools). For example, the maintenance head is a cleaning head comprising one or more cleaning tools (e.g., sweeping or scrubbing brushes). Alternatively, the maintenance head is a treatment head comprising one or more treatment tools (e.g., polishing, stripping or buffing pads). Many different types of surface maintenance tools are used to perform one or more maintenance operations on the surface 120. The maintenance operation can be a dry operation or a wet operation. Such maintenance tools include sweeping, scrubbing brushes, wet scrubbing pads, polishing/burnishing and/or buffing pads. Additionally, one or more side brushes for performing sweeping, dry or wet vacuuming, extracting, scrubbing or other operations can be provided. The maintenance head assembly 400 can extend toward a surface on which a maintenance operation is to be performed. For example, the maintenance head assembly 400 can be attached to the base of the surface maintenance machine 100 such that the head can be lowered to an operating position and raised to a traveling position. The maintenance head assembly 400 is connected to the surface maintenance machine 100 using any known mechanism, such as a suspension and lift mechanism such as those illustrated in U.S. Pat. No. 8,584,294 assigned to Tennant Company of Minneapolis, Minn., the disclosure of each of which is hereby incorporated by reference in its entirety.

In some embodiments, the interior of the surface maintenance machine 100 can include a vacuum system (not shown) for removal of debris from the surface. In such embodiments, the interior can include a fluid source tank (not shown) and a fluid recovery tank (not shown). The fluid source tank can include a fluid source such as a cleaner or sanitizing fluid that can be applied to the surface 120 during treating operations. The fluid recovery tank holds recovered fluid source that has been applied to the surface 120 and soiled. The interior of the surface maintenance machine 100 can include passageways (not shown) for passage of debris and dirty liquid. In some such cases, the vacuum system can be fluidly coupled to the recovery tank for drawing dirt, debris or soiled liquid from the surface. The vacuum system may comprise a vacuum-assisted squeegee (to be described with respect to FIGS. 8-18) mounted to extend from a lower rearward portion 132 of machine 100. Fluid, for example, clean liquid, which may be mixed with a detergent, can be dispensed from the scrubbing fluid tank to the floor beneath machine 100, in proximity to the scrubbing brushes, and soiled scrubbing fluid is drawn by the squeegee centrally, after which it is suctioned via a recovery hose into the recovery tank. Machine 100 can also include a feedback control system to operate these and other elements of machine 100, according to apparatus and methods which are known to those skilled in the art.

In alternative embodiments, the surface maintenance machines 100 may be combination sweeper and scrubber machines 100. In such embodiments, in addition to the elements describe above, the machines 100 may either be an air sweeper-scrubber or a mechanical sweeper-scrubber. Such machines 100 can also include sweeping brushes (e.g., rotary broom) extending toward a surface (e.g., from the underside of the machine 100), with the sweeping brushes designed to direct dirt and debris into a hopper. In the cases of an air sweeper-scrubber, the machine 100 can also include a vacuum system for suctioning dirt and debris from the surface 120. In still other embodiments, the machine 100 may be a sweeper. In such embodiments, the machine 100 may include the elements as described above for a sweeper and scrubber machine 100, but would not include the scrubbing elements such as scrubbers, squeegees and fluid storage tanks (for detergent, recovered fluid and clean liquid).

In use, an operator may ride the machine 100 in a standing position and stand on an operator platform 190. The operator platform 190 can optionally include one or more foot pedals 122, 124 for engaging with maintenance tools 406 extending from below the machine 100, as will be described further below. Continuing with the illustrated embodiment of FIG. 1B, advantageously, the machine 100 includes an operator console 126 provided on the machine 100 body. The operator console 126 can include controls for steering, propelling, and controlling various operations of the machine 100. For instance, the operator console 126 can include a steering control such as a steering wheel 108 such that an operator standing on the operating platform can grasp and turn the steering wheel 108 to turn the machine 100. Further, the operator console 126 can include speed controls (e.g., such as a knob, not shown) that can control the speed of the machine 100 without having to remove the operator's hands from the steering wheel 108 using means well-known in the art. As is apparent from the foregoing disclosure, the operator console 126 can be approximately at the waist-level of an adult operator standing on the operating platform. Such embodiments allow a compact vehicle design while providing easy to use controls to control the operation of the machine 100.

Continuing with FIG. 1B, the surface maintenance machine 100 according to some embodiments can have an overall width 139 of less than about three feet. For example, the machine 100 can have an overall width 139 of less than about 28 inches. As used herein, the term "width" refers to the distance between lateral surfaces 116, 118 (e.g., perpendicular to the longitudinal centerline and/or the transverse centerline 158) of the machine 100. The lateral confines of the machine 100 in such cases are within about 28 inches. In such cases, the machine 100 has a maintenance path corresponding to an envelope of the surface in contact with the maintenance head assembly 400 during a surface maintenance operation. The envelope as used herein can be the area defined by the front surface 112, back surface 114 and two lateral surfaces 116 and 118 of the machine 100. The maintenance path can have a width (e.g., distance between lateral surfaces 116 and 118) of between about 20 inches and about 24 inches. Such machines 100 are sometimes referred to as "micro-riders" because of their compact sizes. While an exemplary micro-rider machine is illustrated, the embodiments disclosed herein can apply similarly to machines of any sizes and configuration.

With continued reference to FIG. 1B, in certain embodiments, the machine 100 comprises three wheels. In the illustrated embodiment, the machine 100 comprises a steerable front wheel 140, and a non-steerable front wheel 142. As shown herein, the steerable front wheel 140 and non-steerable front wheel 142 are positioned toward a lower front portion 144 to the front of a transverse centerline 146 of the machine 100 when the machine 100 is moving in a forward direction 148. As illustrated herein, the transverse centerline corresponds to a line positioned about one-half of the distance 182 between the front wheels 140, 142 and rear wheel 150. Also illustrated in FIG. 1B is a rear wheel 150 positioned near the lower rearward portion 132 to the rear of the transverse centerline 146 of the machine 100 when the machine 100 is moving in a forward direction 148. In some cases, rear wheel 150 comprises a unitary wheel (e.g., one-piece design). For example, in some cases, there may be no other wheels to the rear of the transverse centerline 146 except for a single rear wheel 150. While the rear wheel 150 is shown as being centered on the longitudinal centerline 154 of the machine, small offsets from the central location are still contemplated by the illustrated embodiments, and the rear wheel 150 may not have equal portions extending on opposite sides of the longitudinal centerline 154.

In the embodiments illustrated herein, the front wheel 140 is steered, while the non-steerable front wheel 142 trails along and turns as the machine 100 is turned. Alternatively, both front wheels 140, 142 can be steered. In embodiments disclosed herein, at least one of the front wheels 140, 142 is steered, while the rear wheel 150 may or may not be steered. While the following description is described relative to steering the front wheel 140, it should be noted that both front wheels 140, 142, and rear wheels 150 can be steered in a manner similar to the operation described relative to front wheel 140 below.

The machine 100 comprises a steering assembly having a steering wheel 108 coupled to (e.g., via a steering column and rack and pinion steering mechanism, or other such steering mechanisms known in the art) the steerable front wheel 140. By turning the steering wheel 108, the front wheel 140 can be turned to turn the machine 100 around a corner. The front wheel 140 can be turned by any angle to complete a turn having a desired angle (e.g., less than or equal to 90 degrees), as will be explained further with respect to FIG. 3. Such embodiments can be beneficial in allowing a greater degree of freedom for the steerable-front wheel 140, thereby permitting the machine 100 to be used for maintaining surfaces in narrow spaces (e.g., hallways or aisles with width under about three feet, enter or leave doorways having a width of about 28 inches, perform a zero turn in an aisle of width about 60 inches and the like).

Figure 2:
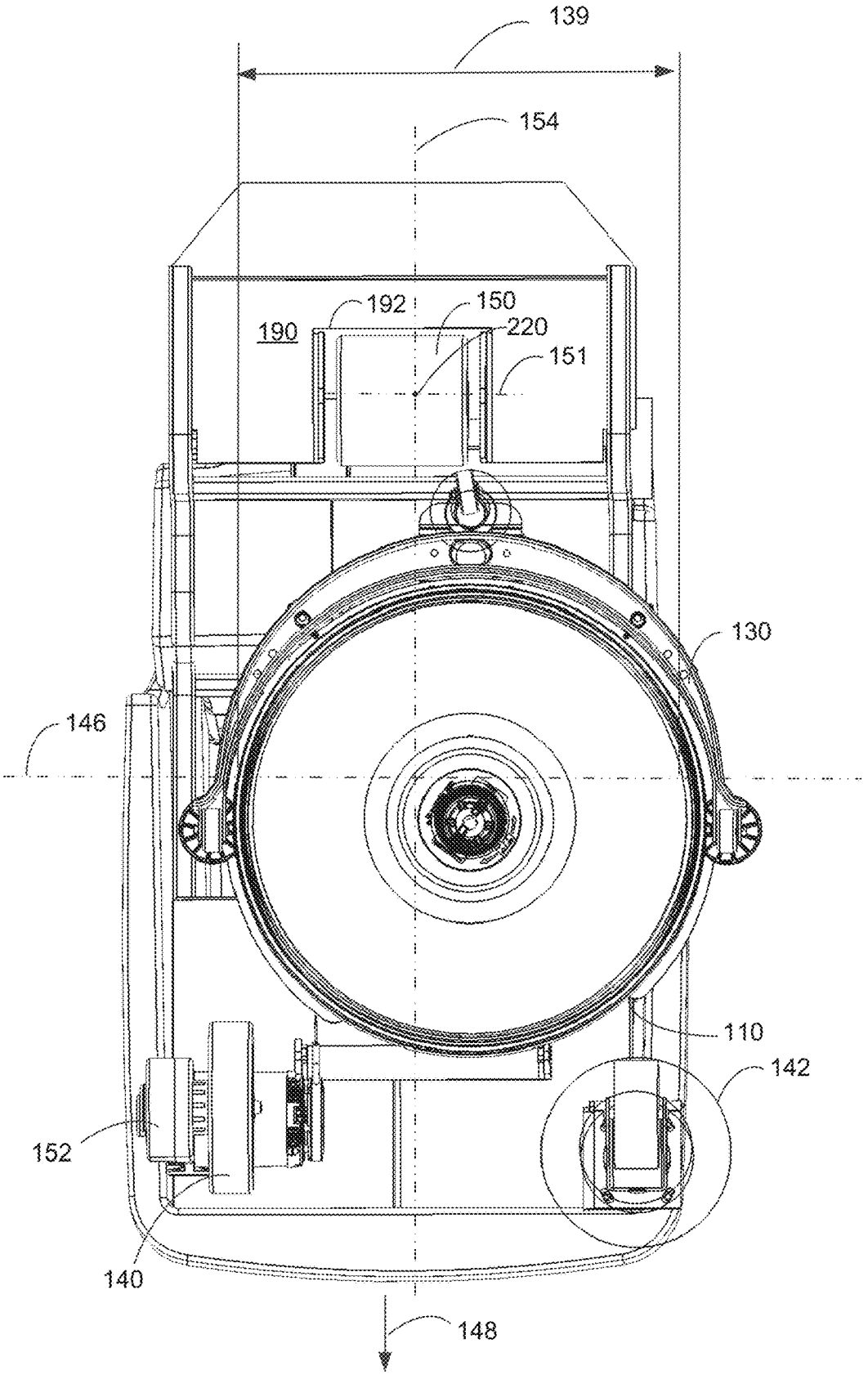
FIG. 2 is a bottom plan view of the surface maintenance machine of FIG. 1B.

Referring now to FIG. 2, the machine 100 can include a motive source 152 for providing motive force to the steerable front wheel 140 to drive the machine 100 on a surface 120. The motive source 152 can be positioned proximal to and coupled to (e.g., directly or via a transmission system) the front wheels 140, 142. As such, the illustrated embodiments represent a front wheel 140 drive and a front steered vehicle. The rear wheel 150 in such cases can be neither steered nor propelled, thereby allowing for the rear wheel 150 to remain substantially stationary when the machine 100 is turned by an operator. The rear wheel 150 in some embodiments can be a non-marking wheel (e.g., made of a material that is resilient relative to the frame 104 of the machine 100) to reduce wheel marks on the surface 120 being maintained. For example, as shown in FIG. 2, the machine 100 can include a motor coupled the steerable front wheel 140 to drive the front wheel 140. In such cases, the non-steerable front wheel 142 may not be propelled by the motive source 152. For example, the non-steerable front wheel 142 can be a caster and remain non-steered and non-driven during normal operation of the machine 100 and merely turn or rotate to facilitate moving the machine 100. As will be further explained below, embodiments such as those illustrated in FIG. 2 can offer improved stability and reduce "rear swing" over other three-wheeled drive and steering systems of machines 100 known in the art, especially when the machine 100 is being turned around a sharp turn (e.g., 90 degrees or more) with respect to the forward direction 148 of the machine 100.

Alternatively, the motive source 152 can propel the rear wheel 150. In such cases, the rear wheel 150 may or may not be steerable, while one or more of the front wheels 140, 142 can be steerable. Any configuration of steering and propelling of the wheels are contemplated, and the embodiments described herein are not limited to the illustrated embodiment shown in FIG. 2. For example, the two front wheels 140, 142 can each steerable by a steering mechanism (e.g., a single steering mechanism steering two front wheels). Similarly, both front wheels 140, 142 can be propelled by the motive source 152 for providing motive force to the front wheels. Alternatively, at least one of the front wheels 140, 142 are steerable by a steering mechanism, and the rear wheel 150 is non-steerable, but can be propelled by a motive source for providing motive force to the rear wheel 150.

During use, an operator may have to turn the machine 100 to perform a surface 120 maintenance operation, or to travel to a different surface. For example, an operator may turn the machine 100 less than or equal to about 180 degrees (e.g., a left turn, a right turn or a U-turn) from the forward direction 148 in a narrow aisle. In such cases, to improve the stability of the machine 100 and also to reduce rear swing, in the embodiments described herein, the rear wheel 150 is neither driven by the motive source 152, nor steered. The machine therefore pivots about a stationary pivot point 220 when turned. When an operator turns the machine 100 by a desired angle (e.g., 90 degrees), the machine 100 turns about the stationary pivot point 220 by the desired angle. As the rear wheel 150 is not driven or steered, its chances of traversing a path having a radius of curvature different from (e.g., wider than) the radius of curvature of the turn are reduced. Such embodiments reduce rear swing and any damage due to collision of the rear of the machine 100 with any obstruction to the rear of the transverse centerline 146 of the machine 100 (e.g., walls, etc.) as the machine 100 is cleaning in the proximity of an obstruction, such as along a wall or around a corner.

Continuing with the above, the stationary pivot point is at the intersection of a longitudinal centerline 154 of the machine and a rotational axis 151 of the rear wheel 150. In some cases, the rear wheel 150 can be an idler wheel. In such cases, the rotational axis 151 of the rear wheel 150 is parallel to the transverse centerline 146 of the machine when the machine turns. Alternatively, in some embodiments, the rear wheel 150 can pivot to a limited extent. In such cases, the rotational axis 151 of the rear wheel 150 is passively pivotable relative to the transverse centerline 146 of the machine. In such cases, the rear wheel 150 is non-steerable and is not propelled, but may pivot to a limited extent similar to a caster. Still further, the rear wheel 150 can be actively steered (e.g., by the steering mechanism and/or a transaxle) and/or propelled (e.g., by the motive source 152). In examples where the rear wheel 150 is actively steered, the rotational axis 151 is actively pivotable with respect to the transverse centerline 146 of the machine by a steering mechanism and/or a transaxle.

Figure 3:
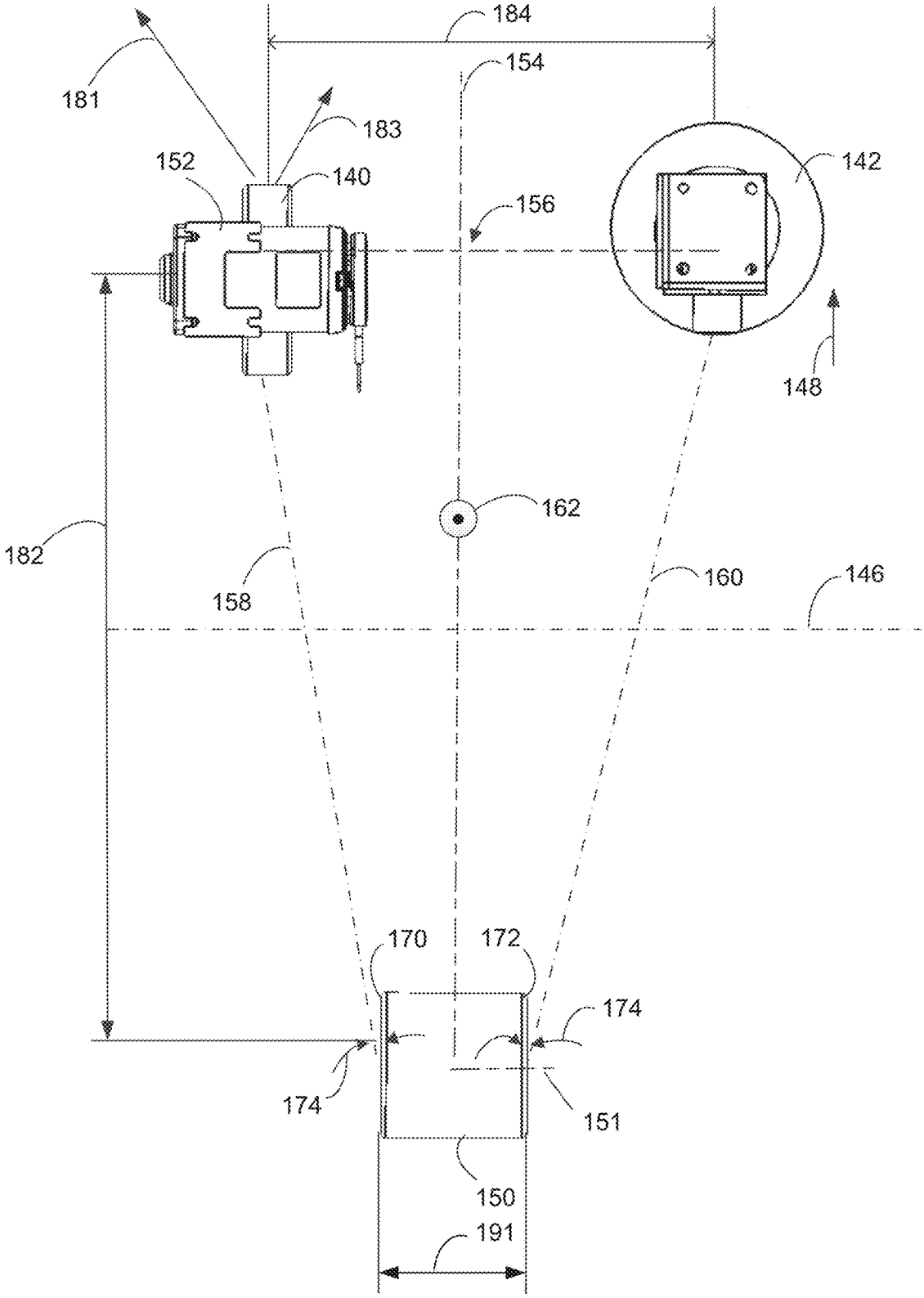
FIG. 3 is a schematic view of the front and rear wheels of the surface maintenance machine of FIG. 1B.

With continued reference to FIG. 2, the rear wheel 150 is generally centered about a longitudinal centerline 154 of the machine 100 such that the rear wheel 150 extends on two opposite sides of the longitudinal centerline 154. As used herein "generally centered" includes small offsets of the rear wheel 150 relative to the longitudinal centerline such that portions of the rear wheel 150 that extend on either side of the longitudinal centerline 154 may not be exactly equal. As illustrated herein, the longitudinal centerline 154 can correspond to a line positioned about one-half of the distance 184 between the front wheels 140, 142. The steerable and non-steerable front wheels 140, 142 may be positioned symmetrically or asymmetrically on either side of the longitudinal centerline 154 of the machine 100. In such cases, as best seen in FIG. 3, the front and rear wheels 140, 142, 150 are arranged in a triangular orientation. When viewed from the bottom, each of the front and rear wheels 140, 142, 150 form a vertex of the triangle 156, with the sides 158, 160 of the triangle 156 tapering from the front of the machine 100 to the rear. As will be described further below, such embodiments with two front wheels 140, 142 and a single rear wheel 150 can offer less sensitivity to center of gravity position over conventional three-wheeled surface maintenance machines (e.g., such as conventional machines having a single front wheel and two rear wheels). In such embodiments, there may be no other wheel other than the rear wheel 150 positioned to the rear of the transverse centerline of the machine that is inline with the rotational axis 151 of the rear wheel. Accordingly, the rear wheel 150 is centrally located such that it is symmetrically positioned on the longitudinal centerline 154 of the machine. In such a configuration, the machine 100 has three contact points with the surface 120, each contact point corresponding to each of the front wheels 140, 142 and the rear wheel 150. The contact points define a contact plane such that no other wheels except the three wheels 140, 142, and 150 contact the surface 120 at the contact plane.

As referred to previously, the front wheel 140 is coupled to a steering wheel 108 to turn the machine 100 by a desired angle, while the rear wheel 150 remains stationary while turning. For instance, as the machine 100 is turned, it may pivot about the center of the stationary rear wheel 150. As shown in FIG. 3, the steerable front wheel 140 (and the motive source 152 coupled thereto) can be offset with respect to the longitudinal centerline 154 of the machine 100. One skilled in the art would recognize that as a result of this orientation, the front wheel 140 turns by a turning angle with respect to the longitudinal centerline 154 wherein the turning angle may be greater than the desired angle by which the machine 100 is to be turned. For example, in the illustrated embodiment, the front wheel 140 is turned by a turning angle greater than 90 degrees (e.g., between about 100 degrees and about 110 degrees) with respect to the longitudinal centerline 154 of the machine 100 to turn the machine 100 away from the longitudinal centerline in the direction 181 shown in FIG. 3. Moreover, if the front wheels 140, 142 are to be spaced further apart than by the distance 184 shown in FIG. 3, the turning angle of the steering wheel 108 increases further from the exemplary angles (e.g., greater than about 110 degrees) described herein in order to turn the machine 100 away from the longitudinal centerline (e.g., along arrow 181) by an angle of about 90 degrees. Similarly, the steering assembly is configured for steering the front wheel by an angle less 90 degrees with respect to the longitudinal centerline of the machine when turning the machine toward the longitudinal centerline (e.g., along the direction 183) by an angle of about 90 degrees.

With continued reference to FIG. 3, the triangular orientation of the front wheels 140, 142 and the rear wheel 150 permits a center of gravity 162 of the machine 100 to be suitably located. For instance, a projection of the center of gravity 162, in the top plan view of FIG. 3 is shown as being positioned substantially toward the front of the transverse centerline 146 and within the triangle 156 formed by the front and rear wheels 140, 142, 150. As is apparent to one of ordinary skill in the art, when the projected position of the center of gravity 162 of the machine 100 lies within the triangular orientation of the front and rear wheels 140, 142, 150, the machine 100 remains in stable equilibrium, and is undue instabilities during use of the machine 100 (e.g., braking during turning, etc.) may be reduced. Such undesirable effects may include excessive lateral acceleration due to centrifugal forces directed radially outward about the center of curvature of the turn that throws the operator outwardly while turning. In some exemplary embodiments, the machine 100 can be front-loaded to position its center of gravity 162 to the front of the transverse centerline 146 and within the triangle 156. For example, heavier components of the machine 100 (e.g., scrub head, battery or other power source, motive source 152 such as motor) can be positioned to the front of the transverse centerline 146. Such embodiments have a weight distribution wherein more of the machine 100's weight is toward its front when an operator is not standing on the operator platform 190 and/or when solution tanks positioned to the front of the transverse centerline 146 comprising clean or dirty liquids are full, thereby moving the center of gravity 162 to the front of the transverse centerline 146 of the machine 100. For instance, in some such cases, the center of gravity can be within the front one-third of the machine 100 (e.g., one-third of the distance 182 shown in FIG. 3) and projected to fall within the triangle 156 formed by the first and second front wheels 140, 142, and the rear wheel 150 when the operator is not standing on the platform 190. In such cases, the position of the center of gravity can be configured to remain generally within the triangle 156 formed by the first and second front wheels 140, 142 and the rear wheel 150 when the operator is standing on the operator platform and the machine is being operated normally. As used herein, "normal operation" can refer to any of the following: being driven on a floor surface, braked, turned, braked during a turn, when solution tanks are empty, when the operator has at least one foot on the operator platform, performing one or more maintenance operations on the surface and the like. Such embodiments can also reduce the chances of the machine 100 (e.g., to the rear of the transverse centerline 146) having weight imbalances when an operator steps on or off from the operator platform 190, and when the operator is standing on the platform 190. For instance, embodiments such as those disclosed herein have reduced instabilities (e.g., tipping, one of the wheels losing contact with the surface, and the like) when the operator has one foot on the operator platform 190. Additionally, the machine reduces instabilities (e.g., tipping, one of the wheels losing contact with the surface, and the like) when the operator has both their feet on the operator platform 190, and when the machine turns, brakes during a turn or travels on an inclined surface.

When the weight of the machine 100 or the operator shifts (e.g., braking during turning or traveling on an inclined surface, etc.) by allowing the center of gravity 162 of the machine 100 to remain lower to the ground and to the front of the machine 100 (e.g., at position 162' shown in FIG. 4A), turning moments (e.g., that could result in instabilities due to lateral forces overcoming gravitational forces acting on the center of gravity of the machine 100) are reduced as is well-known to one of ordinary skill in the art. For example, the projected position of the center of the gravity 162 is positioned in close proximity to the surface 120 such that the center of the gravity 162 is no greater than the lower one-half, and more preferably one-third of the machine height when an operator is standing on the operator platform 190. In some such cases, the machine is stable when the operator is turning the machine (e.g., a zero turn) and/or braking while turning. In some such cases, and referring to FIGS. 1B and 4A, components of the machine 100 can also be arranged such that the a lower portion 164 of the machine 100 below a major center plane 166 of the machine 100 is heavier relative to an upper portion 168 of the machine 100 to above the major plane 166 of the machine 100 when an operator is standing on the operator platform 190. Such embodiments lower the center of gravity 162 so that its projected position is further toward the surface 120, and reduce the machine 100 and/or the operator from experiencing dynamic instabilities during normal use of the machine 100 which can involve operations such as braking during turning, performing a zero turn, or other similar operations. During such operations, even if the weight of the machine 100 or the operator's position shifts, the projected position of the center of gravity 162 lies proximal to the surface 120 and within the lateral confines (e.g., sides 158, 160) of the triangular configuration of the front and rear wheels 140, 142, 150. Such embodiments reduce the potential for the machine 100 to become unstable during routine use of the machine 100.

Figure 4A:
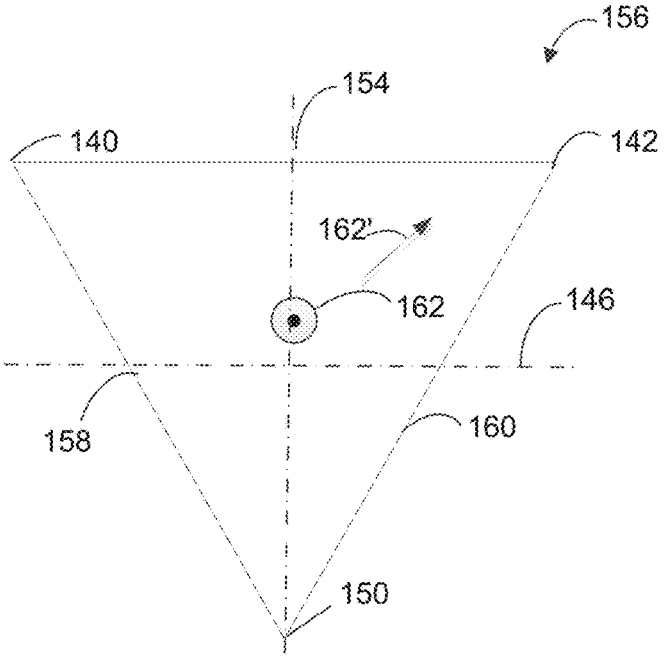
FIG. 4A is a schematic of a the front and rear wheels of the surface maintenance machine of FIG. 1B.

With continued reference to FIG. 3 and referring now to FIG. 4A, the stability of the machine during turning (e.g., zero turns) or braking during turning can be illustrated by the geometric orientation of the front and rear wheels. As seen in FIG. 3, the rear wheel 150 is cylindrical in shape and has a first lateral side 170 and a second lateral side 172. The front wheels 140, 142 are each oriented such that the sides 158, 160 from each of the front wheels 140, 142 abut the lateral sides 170, 172 of the rear wheel 150. In such embodiments, the projected position of the center of gravity 162 is generally contained within the triangular area between the front and rear wheels 140, 142, 150 due to front loading the machine 100. As a result, force and moment imbalances are reduced, thereby allowing the operator to ride, turn, brake during turn or travel over an inclined surface with increased safety.

Continuing with the above, the center of gravity 162 is positioned substantially toward the front of the transverse centerline 146 and projected to fall within the triangle 156 formed by the front wheels 140, 142 and the rear wheel 150 when the operator is standing on the operator platform 190 and performs at least one of turning, braking during a turn, or travel over an inclined surface. As shown by the schematic of FIG. 4A, if for instance, an operator turns the machine and/or brakes during a turn, in an exemplary embodiment, the resulting braking force vector indicated by arrow 162' is toward one of the front wheels when turning.

Figure 4B:
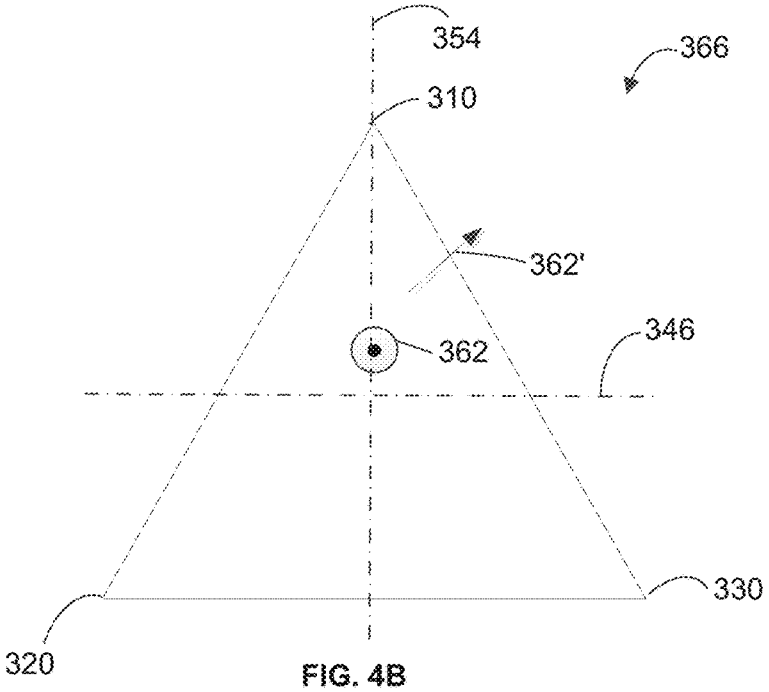
FIG. 4B (PRIOR ART)
FIG. 4B is a schematic of conventional three-wheeled surface maintenance machines.

In conventional three-wheeled machines, a single front wheel 310 and two rear wheels 320, 330 form a triangle 366, where the conventional three-wheeled machine has a longitudinal centerline 354 and a transverse centerline 346 as shown in FIG. 4B. In this embodiment, when an operator brakes during a turn, the location of the center of gravity 362 is inherently connected to the stable operation of the machine. For instance, if an operator turns the machine and/or brakes during a turn, the resulting braking force vector indicated by arrow 362' is toward the line between the front wheel and one of the rear wheels when turning and outside the triangle 366. In contrast, in embodiments of the surface maintenance machine with two front wheels and a single rear wheel illustrated schematically by FIG. 4A, the resulting braking force vector 162' remains generally within the triangle 156, and as result, has relatively improved stability while braking during a turn, ramp climbing or during a zero turn. During these operations of the machine, the machine generally resists various accelerations and decelerations better because of front wheels 140, 142 being wide set and have a substantially broad envelope to the front of the transverse centerline 146 due to two front wheels 140, 142 and a single rear wheel 150. Accordingly, if the machine's normal operations such as turning, braking during a turn remains generally within the triangle 156. The machine therefore has generally improved stability and resists a wheel (e.g., a front wheel inner relative to the radius of a turn) losing its contact with surface on which the machine operates due to moments about the center of gravity 162.

Figure 5:
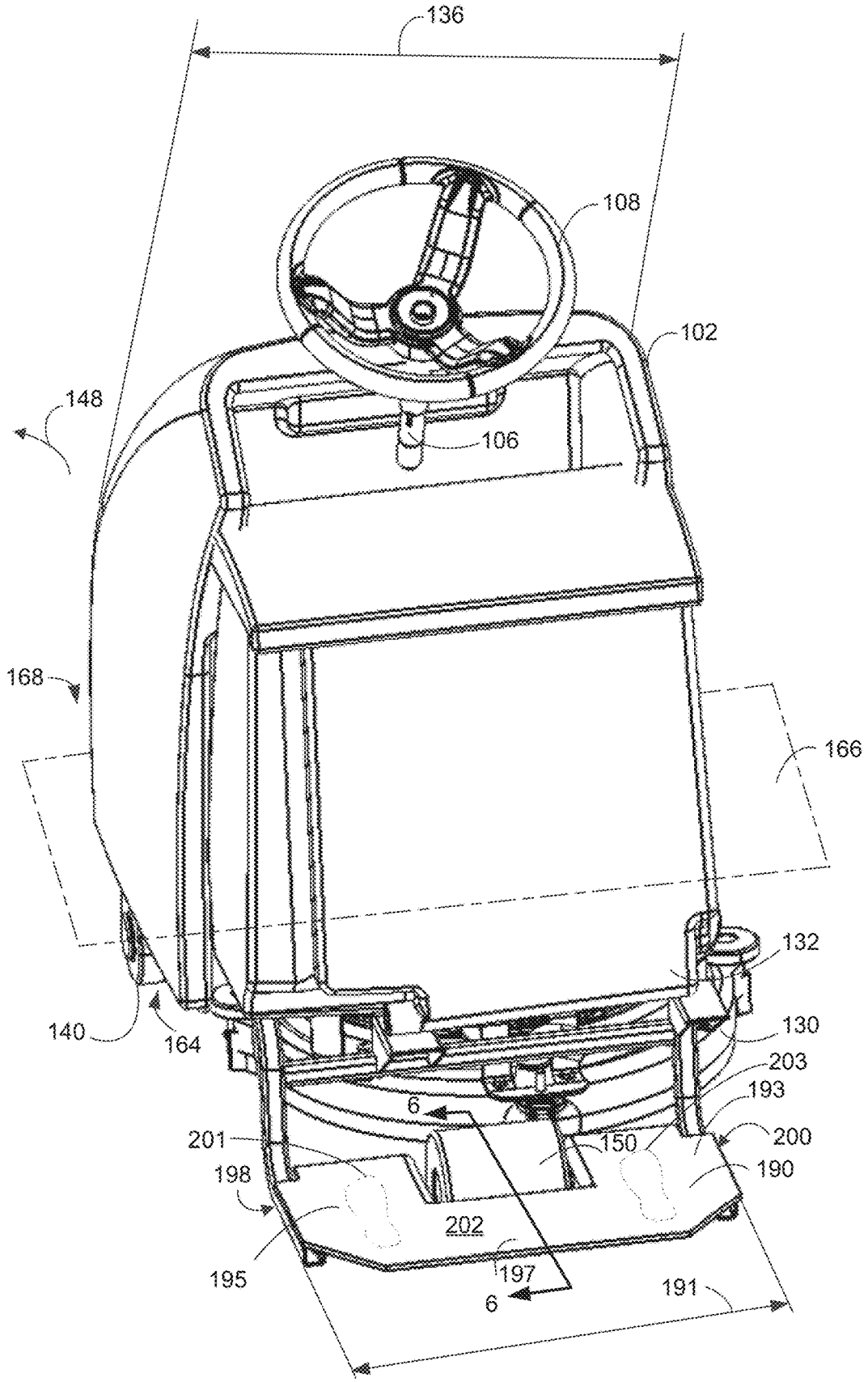
FIG. 5 is a rear perspective view of the surface maintenance machine of FIG. 1B.

Referring now to FIG. 5, the surface maintenance machine 100 comprises an operator platform 190 to allow an operator to stand thereon. The operator platform 190 can be positioned to the rear of the transverse centerline 146 of the machine 100. The operator platform 190 extends around the rear wheel 150, and laterally outwardly from the longitudinal centerline 154 for supporting an operator in a standing position with the operator's legs on either side of the rear wheel 150 as shown in FIG. 1B. The rear wheel 150 can be positioned centrally with respect to the platform. In some such cases, the platform 190 optionally includes a cut-out portion 192. The cut-out portion 192 of the operator platform 190 receives the rear wheel 150. The operator platform 190 comprises a first side portion 193, a second side portion 195 and a central portion 197. The cut-out portion 192 in such cases is surrounded on opposite lateral sides by the first and second side portions 193 and 195. The first and second side portions 193 and 195 are each integrally formed with the central portion 197. As seen in FIG. 5, the first and second side portions 193, 195 extend on opposite sides of the rear wheel 150. An operator can stand in a standing position such that the first and second side portions 193, 195 each receive an operator's foot. Accordingly, the first and second side portions 193, 195 can have a width sufficient to accommodate an operator's foot, 201, 203. For example, the width can be between about 5 inches and about 8 inches such that an adult operator can comfortably stand in the first and second side portions 193, 195 so that the operator's foot 201, 203 are on both sides of the rotational axis 151 (and positioned thereabove). Alternatively, the operator platform 190 may not have a cut-out portion, and can be positioned above the rear wheel 150.

Optionally, in some embodiments wherein the operator platform 190 has a cut-out portion 192, a cover (not shown) can be positioned over the rear wheel 150 to avoid the operator's foot from inadvertently contacting the rear wheel 150. The rear wheel 150 is approximately at the same height above the surface 120 as a central rotational axis of the rear wheel 150. Such embodiments allow the operator a wider tread surface than is conventionally used in "micro" rider style surface maintenance machine 100 by having the rear wheel 150 be positioned centrally, and by having the operator platform 190 extend around it. In some such cases, the operator platform 190 is of a width 191 that approximately equals the width 139 of the maintenance path 137 and/or the width 136 of the machine.

In embodiments illustrated in FIG. 5, during a turn (e.g., a zero turn), the point about which the machine turns (referred to as "center of turn") can generally be within an envelope of the operator platform when the machine is being turned up to and during a zero turn. Such embodiments allow the operator comfort during a turn and further ensure stability during zero turns.

Figure 6:
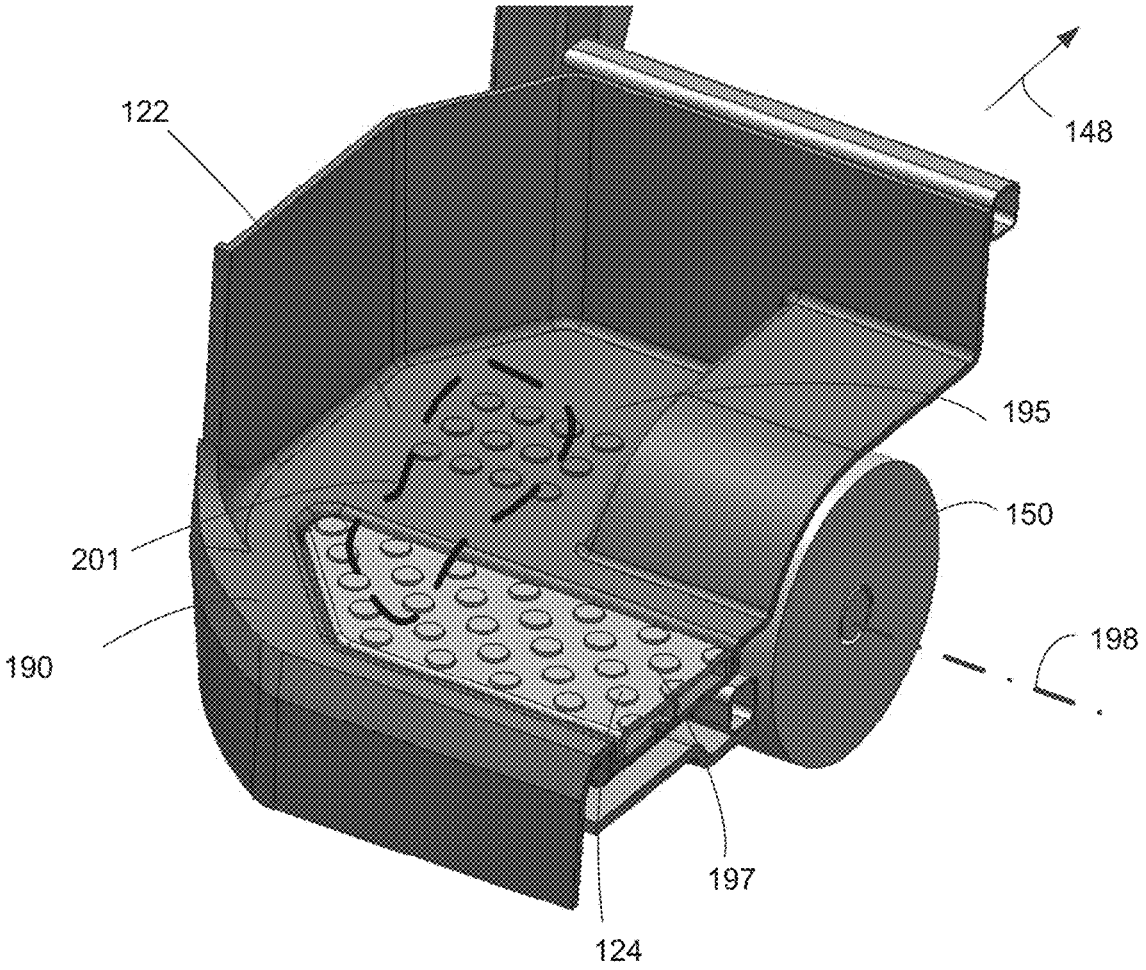
FIG. 6 is a cross-sectional side perspective view of a rear portion of the surface maintenance machine taken along the plane 6-6 shown in FIG. 5.
Figure 7:
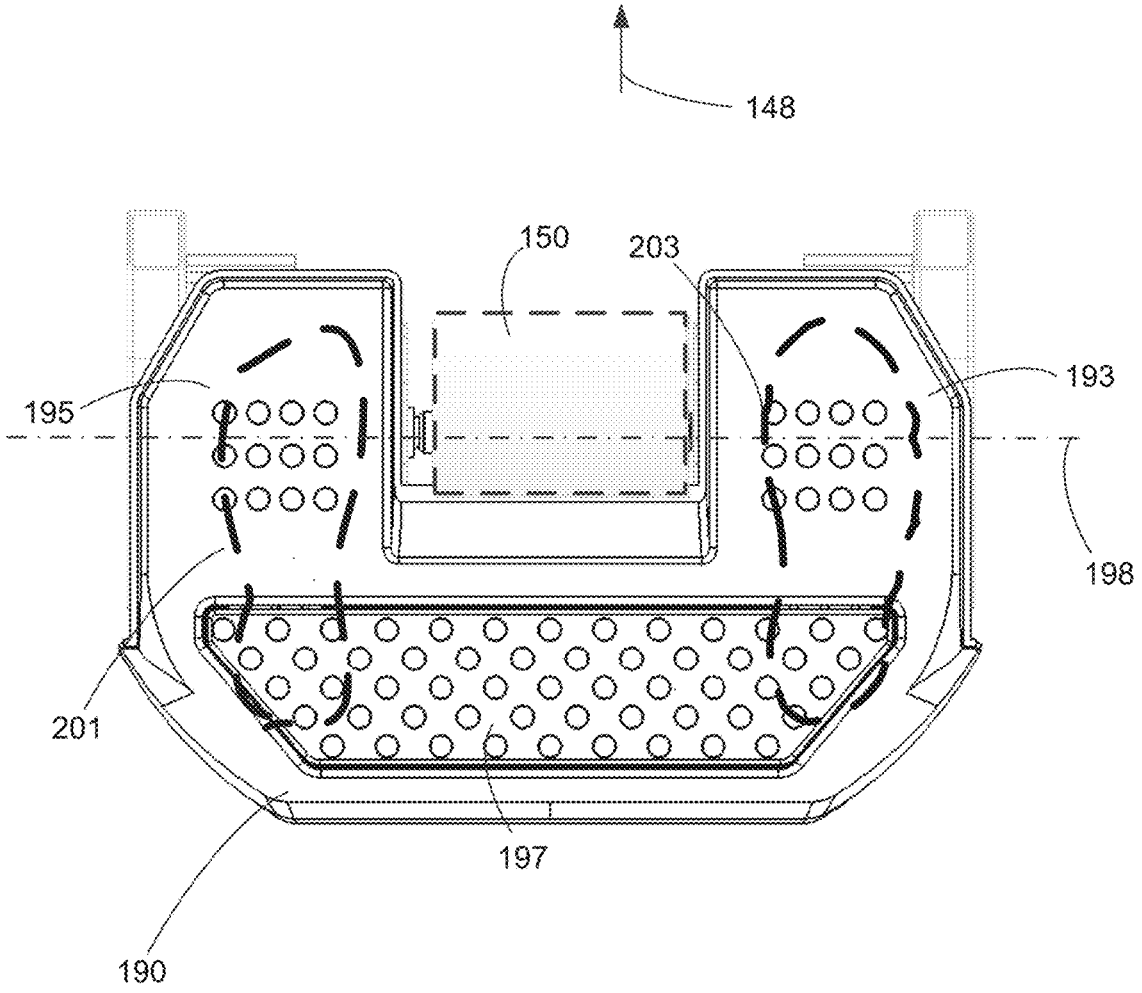
FIG. 7 is a top view of the rear portion of the surface maintenance machine shown in FIG. 6.

FIG. 6 illustrates a side perspective view of a cross-section taken along the plane 6-6 illustrated in FIG. 5. FIG. 7 illustrates a top view of a rear portion of the machine 100. In FIGS. 6 and 7, the forward direction of travel of the machine 100 is illustrated by the arrow referenced as 148. As shown in FIGS. 6 and 7, machine 100 has at least one rear wheel 150. In embodiments where the rear wheel 150 is rotatable, the rotation is about the rotational axis 198. As seen in FIGS. 6 and 7, the operator platform 190 extends both to the front and the rear of the rotational axis 198 of the rear wheel 150. The central portion 197 is to the rear of the rotational axis 198 and the first and second side portions 193, 195 extend to the front and rear of the rotational axis 198. In such embodiments, when an operator stands on the operator platform 190, the operator's feet 201, 203 can be to the front and rear of the rotational axis 198. As is seen in FIGS. 6 and 7, the operator platform 190 also extends to the front and rear of the entire rear wheel 150. The rear wheel 150 is surrounded by the first and second side portions 193, 195 and the central portion 197 of the operator platform 190. The rear wheel 150 can thus be positioned, such that the operator platform 190 extends deeper relative to the diameter of the rear wheel 150.

Embodiments of a surface maintenance machine 100 with a rear operator platform 190 disclosed herein offer several advantages. The rear standing platform allows the operator to standing in a desired position with a wider tread surface than is conventional. The rear standing platform with a wider tread allows the operator to step on and off the machine 100. Components of the machine 100 according some embodiments are arranged to have the machine 100 be front loaded and the center of gravity 162 be lower toward the ground. Such embodiments offer improved stability, and additionally provide for efficient use of space for packaging batteries and cleaning components. Embodiments also provide for a short overall length for the machine 100, forward protection for the operator, low step-on height, and easy presentation of controls to the operator. Embodiments of the machine also allows an operator to rapidly decelerate during a turn, thereby providing a safe operation of the machine (e.g., if an operator encounters an obstacle) and results in satisfactory maintenance performance (e.g., by reducing the chances of scrubbing tools from throwing off liquids when turning too fast).

Figure 8:
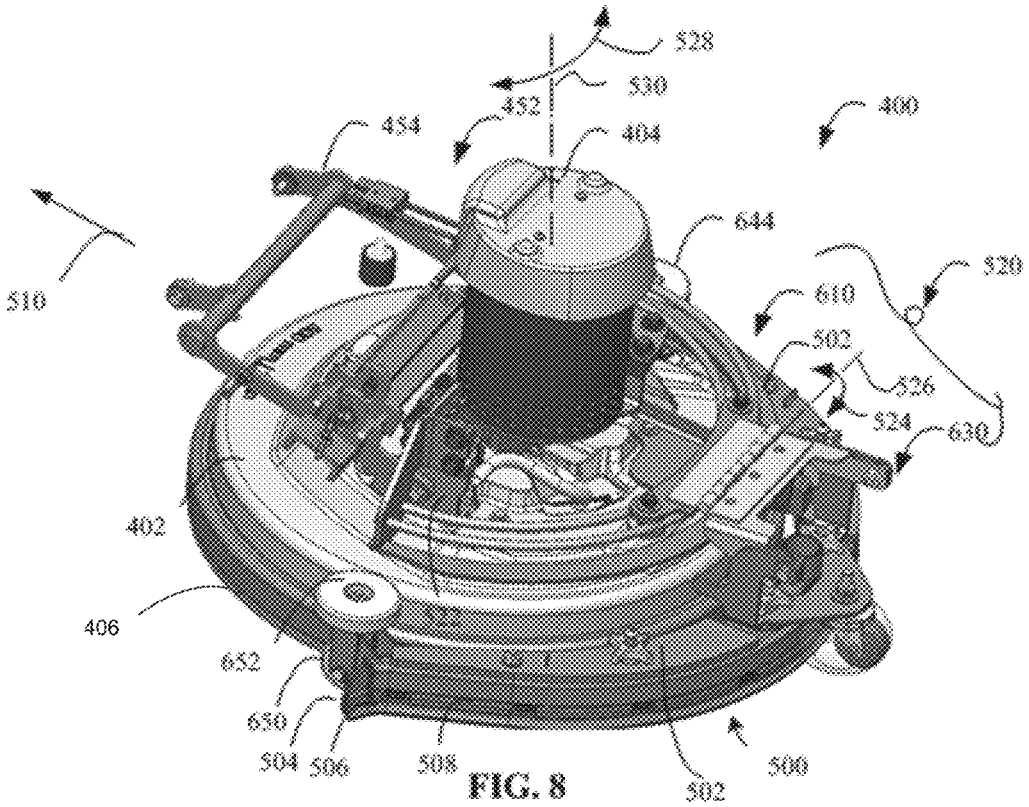
FIG. 8 is a perspective view of a maintenance head assembly of the present disclosure according to an embodiment when the machine is traveling in a generally straight path.

Referring now to FIG. 8, which illustrates a portion of the machine 100 shown in FIG. 1B, the surface maintenance machine 100 includes a maintenance head assembly 400. The maintenance head assembly 400 houses one or more maintenance tools 406 such as scrub brushes, sweeping brushes, and polishing, stripping or burnishing pads, and tools for extracting (e.g., dry or wet vacuum tools) as described previously. The maintenance head assembly 400 comprises a deck 402 that houses one or more maintenance tools 406 (best seen in FIG. 9). The maintenance tool 406 can be rotatable relative to the remainder of the maintenance head assembly 400 (such as the deck 402), for instance, by a motive source 404 (e.g., a motor) that can be coupled to the maintenance tool 406 (e.g., using belts, or other motive force transmission systems, not shown) that apply torque and thereby impart a rotational motion on to the maintenance tools 406. The maintenance head assembly 400 can be attached to the body (e.g., a frame member 104) of the surface maintenance machine 100 such that the maintenance head assembly 400 can be lowered to an operating position (so as to be in contact with the floor surface 120) and raised to a traveling position when the machine 100 is not performing a maintenance operation. The maintenance head assembly 400 is connected to the surface maintenance machine 100 using any known mechanism, such as a lift mechanism and suspension 452, as illustrated in U.S. Pat. No. 9,124,544, assigned to the assignee of the present application, Tennant Company of Minneapolis, Minn., the disclosure of which is hereby incorporated by reference.

With continued reference to FIG. 8, the lift mechanism and suspension 452 allows the maintenance head assembly 400 to be raised and lowered and allows the maintenance tools 406 to conform to undulations in the floor. The deck 402 of the maintenance head assembly 400 is attached to the frame 104 of the machine 100 (not shown in FIG. 8) by a lift mechanism and suspension 452 assembly that includes a lift arm 454, a linear actuator (not shown), and associated coupling structures. Coupling structures include brackets, springs, control arms, and the like for providing controlled pivoting of the linear actuator relative to the deck 402 so as to remain in contact with the floor surface 120 (e.g., when traveling over uneven floor surfaces) when performing a maintenance operation, and be raised to the traveling position when the machine 100 is not performing a maintenance operation.

Components of the lift mechanism and suspension 452 can be operatively coupled to the operator console 126 and/or foot pedals 122 on the operator platform 190. For example, the foot pedals 122 can be mechanically coupled to coupling structures of the lift mechanism and suspension 452. Additionally, the foot pedals 122 can be electrically coupled to a controller in communication with the linear actuator such that when the foot pedals 122 are pressed by the operator's feet, the controller communicates with the linear actuator to raise or lower the maintenance bead assembly to move it between the operating position and the transport position.

With continued reference to FIG. 8, a squeegee assembly 500 is provided on the rear of and connected to the maintenance head assembly 400. The squeegee assembly 500 can drag on the surface along the sides of maintenance tool 406 to keep water on the floor from spreading out sidewise away from the machine 100. The squeegee assembly 500 curves inward to direct the water centrally to the machine 100 toward the rear thereof. A vacuum system (not shown) is fluidly coupled to the squeegee assembly 500 so as to collect the water accumulating on the rear of the machine and deposit the collected water into a waste recovery tank (not shown). The maintenance head assembly 400 can be configured to "float" relative to machine 100, thereby keeping the maintenance tool 406 (e.g., a brush or a pad) in contact with the surface being maintained (e.g., cleaned or treated) even if the surface is somewhat irregular or uneven. Likewise, due to the mechanical connection between the squeegee assembly 500 and the maintenance head assembly 400, the squeegee assembly 500 can also float relative to machine 100 to enable the squeegee assembly 500 to remain in contact with surfaces being maintained, even though they are somewhat irregular or uneven.

The squeegee assembly 500 includes a frame 502, squeegee blades 504, 506, and a retainer 508. Blades may include one or more flexible blades that may be spaced apart or tight against each other. For instance, the illustrated embodiment provides an inner squeegee blade 504 facing the maintenance head assembly 400, and an outer squeegee blade 506 positioned to the rear of the inner squeegee blade 504 (e.g., when the machine is moving in a generally forward direction). The inner squeegee blade 504 generally confronts water on the floor surface 120 first and directs water toward a central portion of the squeegee blades 504, 506. Further, the inner squeegee blade 504 and outer squeegee blade 506 may be in contact with the floor surface 120. In some such cases, the inner squeegee blade 504 can have vents to draw-in liquids into a plenum formed by the inner squeegee blade 504 and outer squeegee blade 506. The squeegee blades 504, 506 can therefore form a seal with the floor. The vacuum system may apply a vacuum in the plenum between the outer and inner squeegee blades 504, 506, which, due to the seal formed with the floor surface 120, and optionally due to vents on the inner squeegee blade 504, facilitates suction of collected water from the center of the squeegee. Squeegee blades 504, 506 can also deflect in a controlled manner to a predetermined extent (for instance, deflection about twice the thickness of the blade) to effectively collect liquids from the floor surface.

The blades can contact the floor surface 120 and are made from suitable material such as rubber, neoprene, urethane, or the like. The one or more flexible blades may be of the same or of differing thicknesses, have differing levels of flexibility, and may have differing lower extents. Exemplary squeegee assemblies contemplated in the present disclosure include the squeegee assemblies described in U.S. Pat. No. 9,049,975, assigned to the assignee of the present application, the disclosure of which is hereby incorporated by reference. The squeegee assembly 500 can be of a sufficient weight so as to apply uniform pressure on the squeegee blades 504, 506 substantially around the perimeter of the squeegee assembly 500. For instance, the weight of the squeegee assembly 500 can be configured so as to apply a certain magnitude of downforce on the squeegee blades 504, 506. Additional mechanical members (e.g., wheels and castors, as will be described further below) can further facilitate uniform application of downforce on the squeegee assembly 500.

As described further below, embodiments of the present disclosure permit an interchangeable squeegee assembly 500 that can be connected to different sizes of maintenance tools 406 (brushes or pads), while facilitating easy removal for servicing (e.g., replacing or "rotating" squeegee blades 504, 506 due to wear). Further, the squeegee assembly 500 according to certain embodiments of the present disclosure can also be designed as articulating, so as to effectively direct and collect water from the surface when the machine is being turned (e.g., around a corner in a building).

Figure 9:
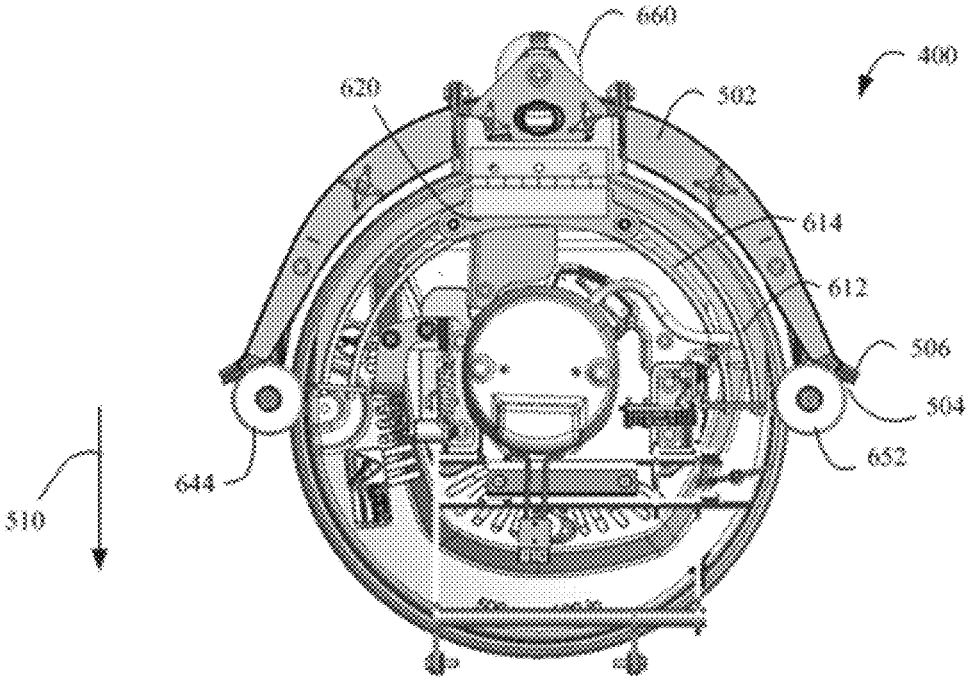
FIG. 9 is a top plan view of the maintenance head assembly of FIG. 8.
Figure 10:
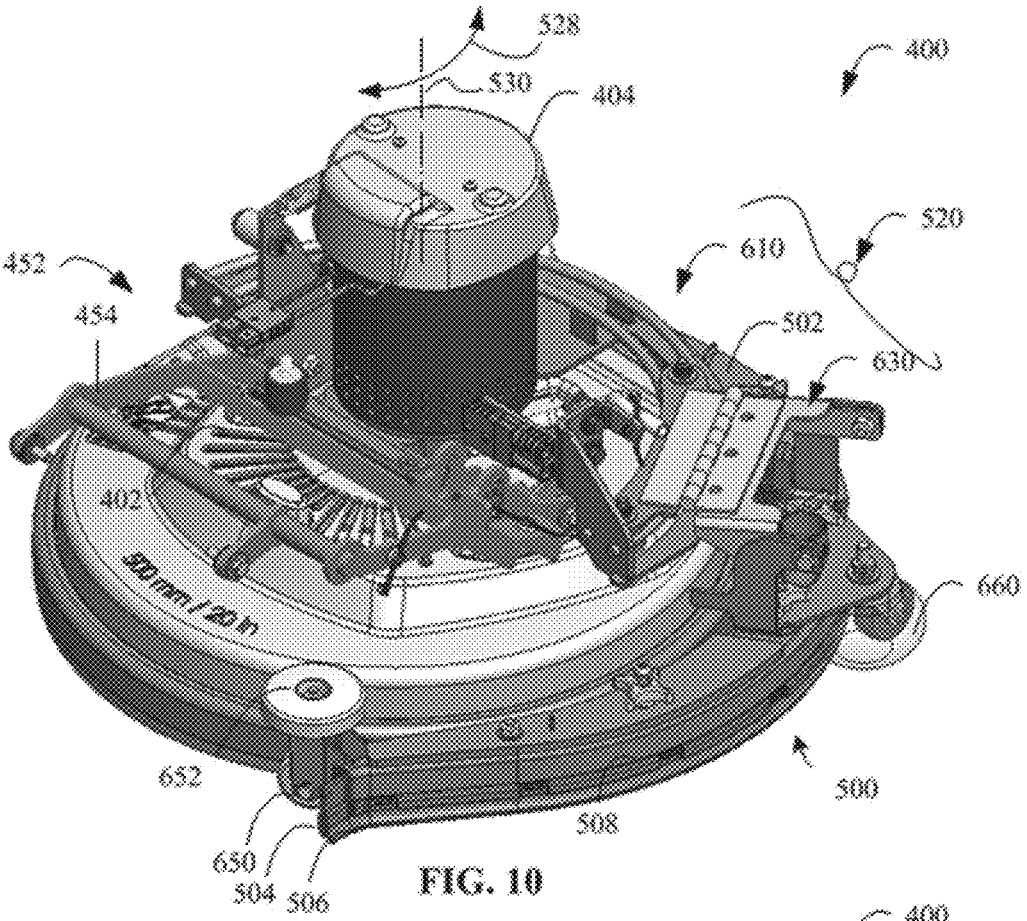
FIG. 10 is a perspective view of a maintenance head assembly of FIG. 8 when the machine turns.
Figure 11:
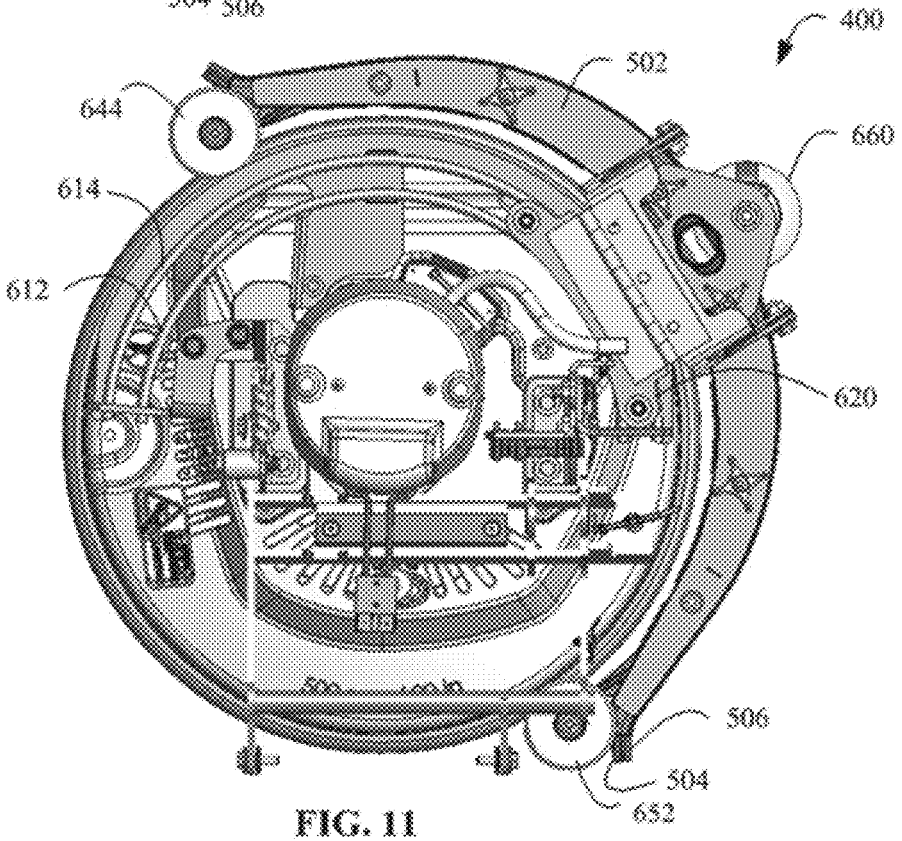
FIG. 11 is a top plan view of the maintenance head assembly of FIG. 10.

FIG. 9 is a top plan view of the assembly shown in FIG. 8 to illustrate the relative position of the squeegee assembly 500 and the maintenance head assembly 400 when the machine is traveling in a generally straight path in a direction indicated by the arrow. FIGS. 10 and 11 show respectively, a perspective view and a top plan view of the squeegee assembly 500 of FIGS. 8 and 9 to illustrate the relative position of the squeegee assembly 500 and the maintenance head assembly 400 when the machine takes a turn relative to the direction 510. As seen in FIGS. 8-11, some embodiments of the present disclosure advantageously provide an articulating mechanism 520 to permit controlled articulation of the squeegee assembly 500 when the machine is turned (e.g., a right or a left turn, relative to the travel direction shown in FIG. 8) to direct and collect water that may pool up when the machine is turned.

Referring now to FIG. 8, the articulating mechanism 520 is attached to coupling structures on the deck 402 of the maintenance head assembly 400. For example, the articulating mechanism 520 can be connected to brackets 522 to which the lift arm 454 of the lift mechanism and suspension 452. Of course, the articulating mechanism 520 can also be connected at other locations on the deck 402 of the maintenance head assembly 400. The connection of the articulating mechanism 520 can be such that it is easily removable in the event that the squeegee assembly 500 needs to be replaced for servicing. For instance, the connection of the articulating mechanism 520 can be to the exterior of the motive source 404 (e.g., motor) of the maintenance head assembly 400, so that an operator may be able to detach the squeegee assembly 500 without having to disconnect numerous connections such as those of the lift mechanism and suspension 452, and the like.

As seen in FIGS. 10 and 11, the articulating mechanism 520 permits controlled articulation of the squeegee assembly 500. As used herein, the term articulation may include both pivotal motion (along arrows 524) of the squeegee assembly 500 relative to the maintenance head assembly 400 about a pivot axis 526, as well as swivel motion (along arrows 528) of the squeegee assembly 500 about the swivel axis 530. In some exemplary embodiments, the articulating mechanism 520 may permit a swivel of about 80 degrees either side of the swivel axis 530, thereby a total swivel arc of about 170 degrees. Such embodiments permit effectively collecting water from behind the machine when the machine completes a sharp turn of about 90 degrees. In such cases, as is apparent to one skilled in the art, the swivel axis 530 of the squeegee assembly 500 generally coincides with the center of turn of the machine and/or centroid of the maintenance head assembly 400.

Figure 12:
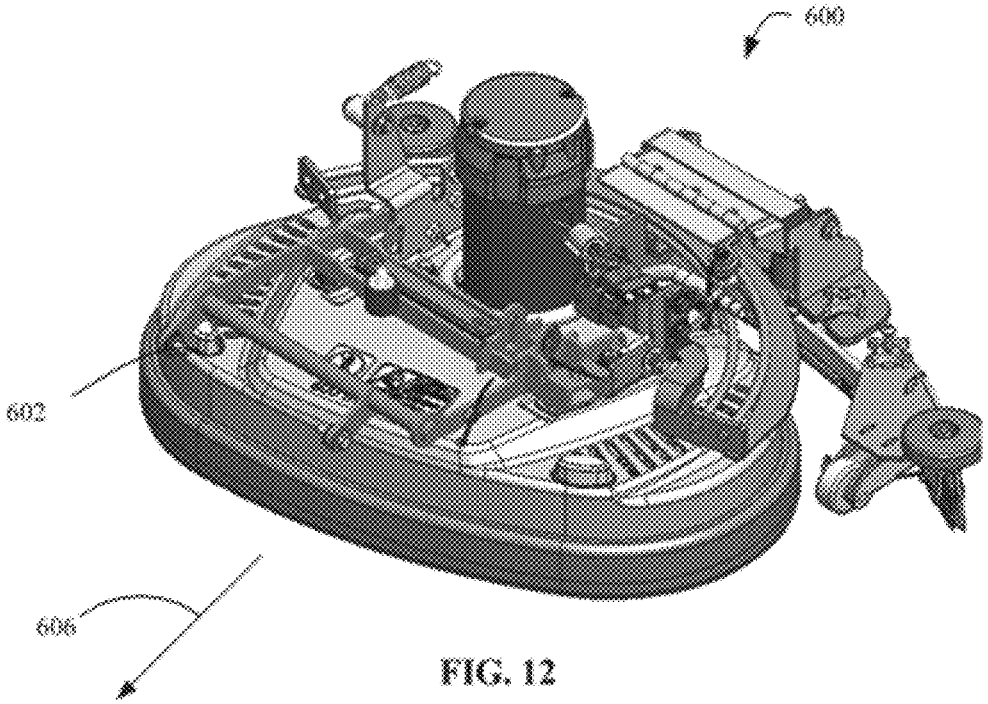
FIG. 12 is a perspective view of a maintenance head assembly of the present disclosure according to another embodiment when the machine is traveling in a generally straight path.
Figure 13:
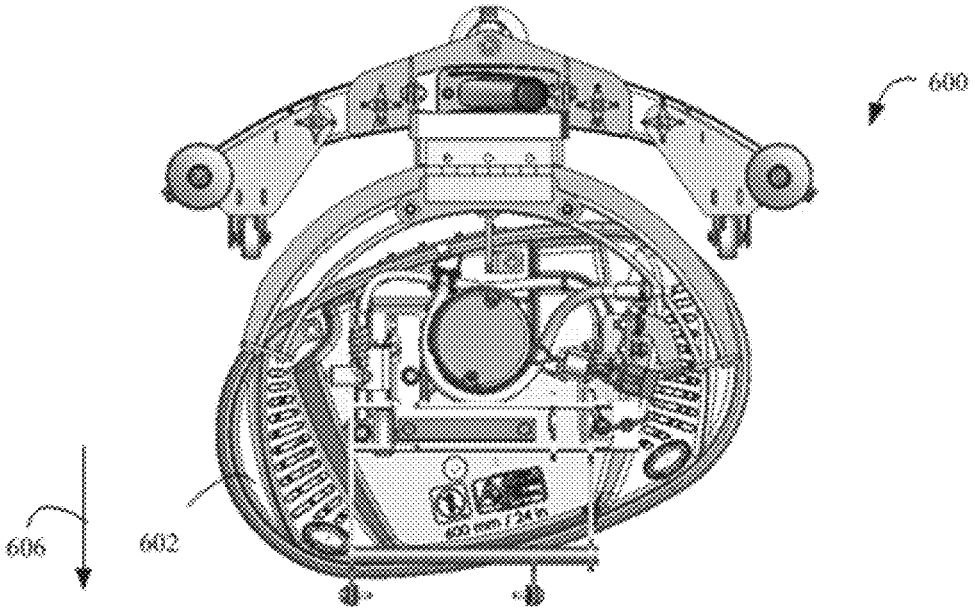
FIG. 13 is a top plan view of the maintenance head assembly of FIG. 12.
Figure 14:
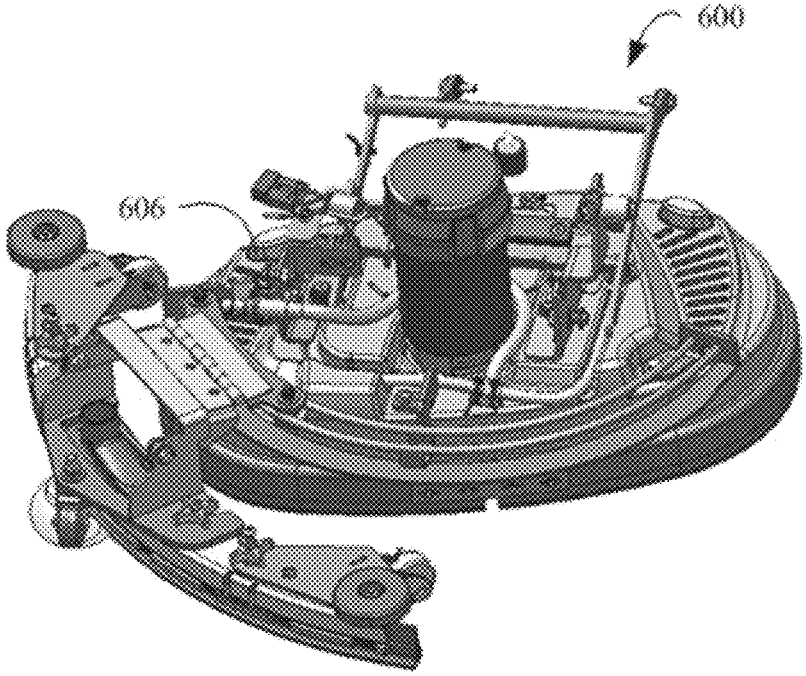
FIG. 14 is a perspective view of a maintenance head assembly of FIG. 12 when the machine turns.
Figure 15:
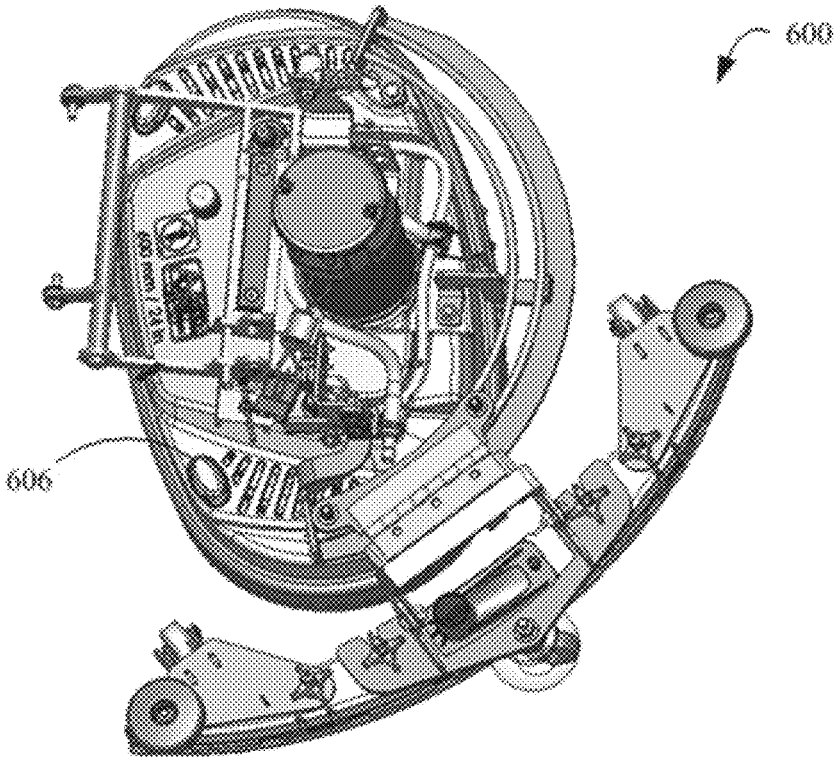
FIG. 15 is a top plan view of the maintenance head assembly of FIG. 14.

FIGS. 12 and 13 illustrate another embodiment of the maintenance head assembly 600. The maintenance head assembly 600 of FIGS. 12 and 13 are substantially similar to that illustrated in FIGS. 8 and 9, with the exception that the embodiment of FIGS. 12 and 13 is generally oval in shape (as seen from the top plan view of FIG. 13), with a deck 602 configured to house a pair of disc-shaped maintenance tools (e.g., brushes or pads), whereas the embodiment of FIGS. 8 and 9 is generally circular in shape (as seen from the top plan view of FIG. 9). In the view shown in FIGS. 12 and 13, the machine is traveling in a generally straight path, in a direction indicated by the arrow 606. FIGS. 14 and 15 show respectively, a perspective view and a top plan view of the maintenance head assembly 600 of FIGS. 12 and 13 to illustrate the relative position of the squeegee assembly 500 and the maintenance head assembly 600 when the machine takes a turn. While the articulating mechanism 520 is described above with respect to FIGS. 8-11, it should be understood that the articulating mechanism 520 shown in FIGS. 12-15 operates in a similar fashion to that shown in FIGS. 8-11.

Figure 16:
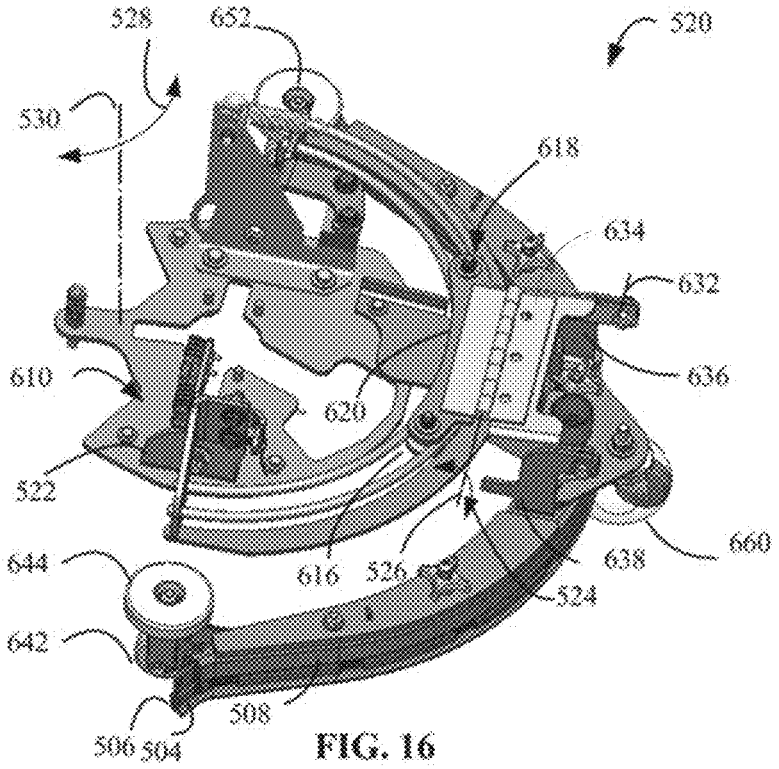
FIG. 16 is an articulating mechanism for the squeegee assembly for the maintenance head assembly disclosed in the present application.
Figure 17:
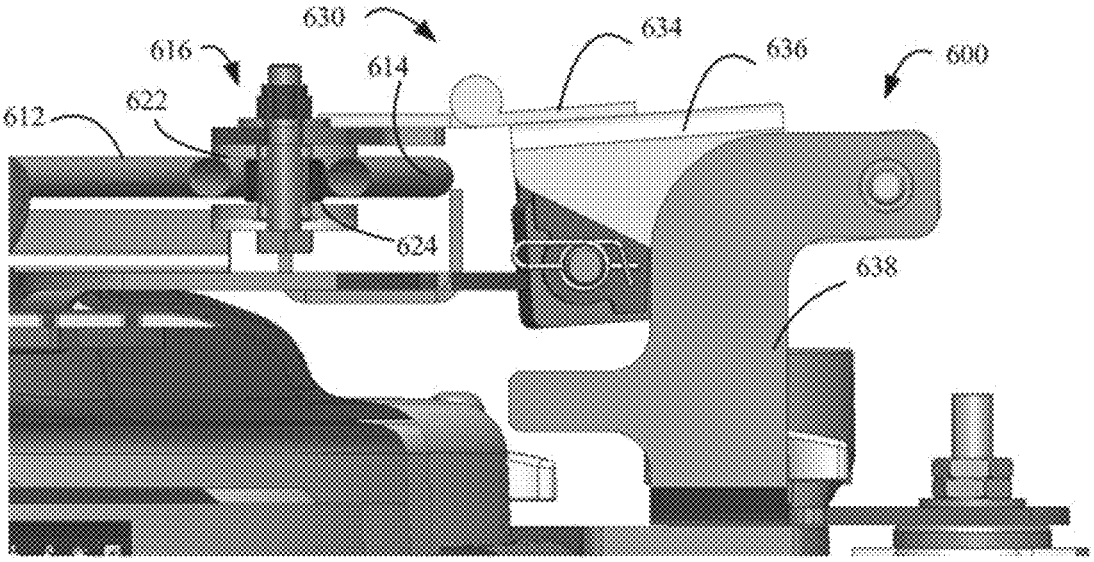
FIG. 17 is a cross-sectional side view of the articulating mechanism of FIG. 16.

FIG. 16 illustrates an enlarged perspective view of the articulating mechanism 520. The articulating mechanism 520 seen in FIG. 16 can be coupled to the maintenance head assembly 400 shown in FIGS. 8-11 or maintenance head assembly 600 shown in FIGS. 12-15. As seen therein, the articulating mechanism 520 comprises a swivel mechanism 610 for controlled swivel of the squeegee assembly 500 about the swivel axis 530 and a hinge mechanism 630 for controlled pivoting of the squeegee assembly 500 about the pivot axis. The swivel mechanism 610 comprises at least one curved rail on which two or more rollers 616, 618 are guided. In the illustrated embodiment, two curved rails 612, 614 radially offset from each other. The rails 612, 614 are curved such that they have a center of curvature that coincides with the swivel axis 530, and in turn, the center of turn of the machine and/or centroid of the maintenance head assembly 400. In the illustrated embodiment, the curvature of the rails 612, 614 corresponds to an arc extending between about 130 degrees and about 180 degrees. Further, the curvature of the rails 612, 614 is generally circular (e.g., as seen from the top view of FIGS. 9, 5, 7 and 9) such that any two points on the rails 612, 614 are generally equidistant from the center of the curvature of the rails 612, 614 (as is apparent from FIGS. 12-15). While two rails having a fixed radius corresponding to a circular shape is illustrated, other shapes of the rails 612, 614 (e.g., a non-circular curvature) can be used to customize the articulating mechanism based on the machine architecture. For example, the rails 612, 614 can follow a generally oval shape when viewed from the top so as to conform to the shape of the oval maintenance head assembly shown in FIG. 12-9. Alternatively, a non-uniform shape can also be used for other machine and/or maintenance head assembly architectures.

While the rails 612, 614 are illustrated as being generally tubular in shape, other shapes such as rectangular or square cross-section are contemplated within the scope of the present disclosure. Further, in addition to being radially offset, the rails 612, 614 can be axially offset (e.g., along the swivel axis 530) such that one rail is above another rail. Alternatively, the rails 612, 614 may not be radially offset, but may be axially offset such that one rail is above another rail, but both rails have the same radius from their center of curvature. Any orientation of the rails 612, 614 that is adequately rigid and resists structural loads (e.g., flexures) generated due to swiveling of the squeegee assembly 500 when the machine turns, and supports the weight of the squeegee assembly 500 can be used. Additionally, while rails are illustrated, it should be noted that track and carriage systems or other mechanical equivalents that permit guided motion of the squeegee assembly 500 over an arcuate path are contemplated within the scope of the present disclosure.

With continued reference to FIG. 16, the swivel mechanism 610 comprises a pair of rollers 616, 618 housed in a swivel bracket 620 that roll against the rails 612, 614. The rollers 616, 618 and rails 612, 614 can be configured to have minimal friction therebetween such that the rollers 616, 618 freely roll in a guided fashion along the rails 612, 614. For instance, and referring now to the sectional view of FIG. 17, the rollers 616, 618 comprise an outer sleeve 622 made of low-friction materials such as Delrin, nylon, and the like permitting frictionless rolling motion of the outer sleeve 622 on at least one rail (for instance, the inner rail 612). Additionally, the rollers 616, 618 can also roll on the outer rail 614. Further, the rollers 616, 618 comprise a metal bushing 624 housed within the outer sleeve 622 so that the rollers 616, 618 can maintain structural rigidity and withstand dynamic loads experienced while rolling on the rails. For example, while the outer sleeve 622 may roll against at least one of the rails 612, 614 when the machine turns, the bushing 624 may be substantially stationary relative to the outer sleeve 622 so as to support and balance the articulating motion of the squeegee assembly 500 and associated loads acting thereon. The outer sleeve 622 of the rollers 616, 618 can have end caps that engage with at least one of the rails 612, 614, and to reduce the chances of the rollers 616, 618 separating from the rails 612, 614. In the illustrated embodiment, the rollers 616, 618 are shaped to resemble spools, although any shape that provides the above-described function is contemplated within the scope of the present disclosure.

Referring back to FIG. 16, the rollers 616, 618 are connected to the swivel bracket 620 by way of a bolted connection. When connected, the rollers 616, 618 are spaced apart from each other along a circumferential direction by an arc distance. In the illustrated embodiment, the spacing between the two rollers 616, 618 extends an arc of between about 15 degrees and about 30 degrees. Such embodiments provide sufficient resistance to certain forces by spreading out such forces acting on the swivel mechanism 610 over a larger area. For instance, if the squeegee assembly 500 abuts against an obstacle and experiences side impact when the squeegee assembly 500 has swiveled to the position shown in FIGS. 10-11 or FIGS. 14-15, the side impact experienced by the squeegee assembly 500 is spread out over a substantial area of the swivel bracket 620, thereby reducing damage to the swivel mechanism 610. As is apparent to one skilled in the art, further spacing the rollers 616, 618 apart may provide additional area to distribute impact loads, however, at the expense of reduced swivel path. While the examples illustrated herein permit a swivel of about 80 degrees on either side of the swivel axis 530 (for a total of about 170 degrees), larger or smaller swivel is contemplated within the scope of the present disclosure. For example, the swivel can be between about 100 degrees and about 270 degrees. Similarly, roller spacing greater than or less than those illustrated (e.g., between about 15 degrees and about 30 degrees) are contemplated within the scope of the present disclosure.

Referring back to FIG. 8, as alluded to before, the rails 612, 614 are connected to the maintenance head assembly 400 by way of brackets 522 and a bolted connection. Advantageously, the brackets 522 connect to the brackets of the lift mechanism and suspension 452 which provides a compact connection of the squeegee assembly 500 to the maintenance head assembly 400. The brackets, while illustrated as L-shaped, can be of any shape so as to serve as limit stops for the swivel mechanism 610 to reduce the chances of the squeegee assembly 500 traveling too far, and being damaged (e.g., by making contact with wheels 140 of the machine). In the illustrated embodiment, the brackets are positioned diametrically opposite to each other (e.g., about 180 degrees apart) accommodate a swivel arc of between about 100 degrees about 180 degrees, though of course, the brackets 522 may be positioned closer or farther apart.

Referring again to FIG. 16, the articulating mechanism 520 comprises a hinge mechanism 630 for controlled pivoting of the squeegee assembly 500 relative to the maintenance head assembly 400 about one or more pivot axes. The hinge mechanism 630 facilitates maintaining the squeegee assembly 500 (e.g., squeegee blades 504, 506) generally parallel to the floor. The hinge mechanism 630 permits the squeegee blades 504, 506 (e.g., the outer squeegee blade 506) to remain in contact with the floor surface 120. The hinge mechanism 630 is a double-hinge design, permitting pivoting of the squeegee assembly 500 relative to the maintenance head assembly 400 about a first pivot axis 526, and a second pivot axis 632. The first pivot axis 526 offset vertically above the second pivot axis 632. The hinge mechanism 630 comprises a hinge plate 634 that engages with the swivel bracket 620 at one end, and an H-shaped hinge bracket 636 at the other end. The first pivot axis 526 passes through the hinge plate 634. The hinge bracket, in turn is connected with vertical brackets 638 by a bolted connection. The second hinge axis passes through the bolted connection between the hinge bracket and the vertical brackets 638.

Such a configuration may permit the squeegee to be in contact with the floor surface 120 in different modes. For instance, the machine may be operated when the squeegee picks up water from floor while the maintenance tool 406 (e.g., scrub brush) is in contact with the floor surface 120 and is performing a maintenance operation (e.g., scrubbing). Alternatively, the machine may be operated such that the squeegee picks up water from the floor while the maintenance tool 406 is not in contact with the floor surface 120, for instance, when excess water from a flooding may have to be picked up from the ground. Still further, the squeegee may have to not be in contact with the floor surface 120 while the maintenance tool 406 is performing a maintenance operation (e.g., a pre-soak while scrubbing). In such cases, the double hinge design of the hinge mechanism 630 allows the squeegee assembly 500 to be raised above or below the maintenance head assembly 400, while also permitting the squeegee blades 504, 506 to be parallel to the floor surface 120. Such embodiments advantageously offer effective water pick-up which may not be possible with hinge mechanism 630 that permit pivoting about a single pivot axis. Instead of the illustrated hinge mechanism 630, mechanical equivalents, such as a vertically-oriented slot and/or rollers housed within the vertical slot can also be used in alternative embodiments.

Figure 18:
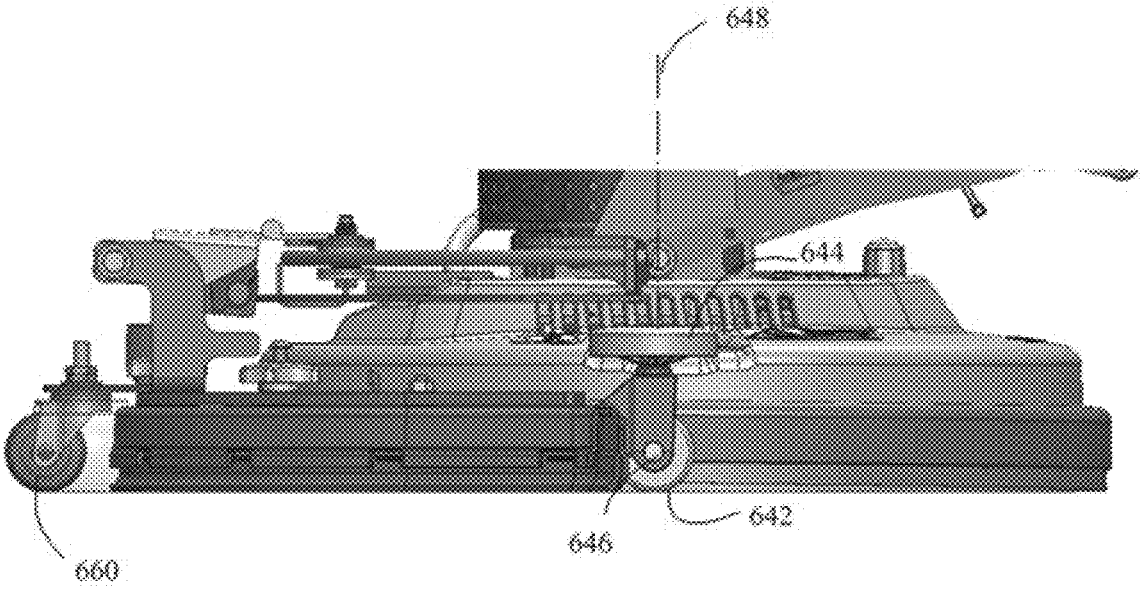
FIG. 18 is an enlarged side view of the squeegee assembly.

FIG. 18 illustrates a side view of the squeegee assembly 500 of the present embodiment. As mentioned above, the embodiment illustrated in FIG. 18 can be used interchangeably with the maintenance head assembly 400 shown in FIGS. 8-11 or FIGS. 12-15. The squeegee assembly 500 comprises a first set of end wheels. In the illustrated embodiment, the squeegee assembly 500 comprises four end wheels. A first end wheel 642 is configured to roll on the surface 120 when the squeegee assembly 500 articulates (e.g., into the positions shown in FIGS. 10, 11, 14 and 15) when the machine turns. Further, a second end wheel 644 provided with a rotational axis 646 perpendicular to the rotational axis 648 of the first end wheel 642. Further, the first end wheel 642 may swivel about the plane containing the rotational axis 646, for instance, relative to the maintenance head assembly as illustrated in FIG. 18. As is apparent to one skilled in the art, the squeegee assembly 500 comprises a second set of end wheels opposite to the first set of end wheels so that the first and second set of end wheels terminate at the opposite ends of the curved squeegee assembly 500. Similar to the first set of end wheels, the second set of end wheels may comprise a third end wheel 650 configured to roll on the surface 120 when the squeegee assembly 500 articulates (e.g., into the positions shown in FIGS. 10, 11, 14 and 15) when the machine turns. Further, a fourth end wheel 652 provided with a rotational axis perpendicular to the rotational axis of the third end wheel 650. While end wheels are illustrated as cylindrical members that can swivel, it should be understood that castors may also be used in lieu of end wheels without loss of functionality. In the illustrated embodiment, end wheel 652 may act as a bumper when the squeegee assembly encounters lateral impacts due to an obstruction (e.g., a wall), whereas the end wheel 644 can support the front of the squeegee assembly during transport. Instead of wheels 644 and/or 652, as is apparent to one skilled in the art, other mechanical means that act as bumpers and/or supports (e.g., simple brackets) may be used without loss of functionality.

In addition to the set of end wheels, as is seen from FIG. 18, the squeegee assembly 500 includes a caster 660 positioned centrally between the first and second set of end wheels. As indicated previously, the mass of the squeegee assembly 500 facilitates applying a predetermined magnitude of downforce on the squeegee blades 504, 506. The end wheels (e.g., first end wheel and third end wheel 650) and caster 660 can further facilitate uniform application of downforce on the squeegee assembly 500.

The caster 660 and/or end wheels may also facilitate articulating the squeegee assembly 500 corresponding to the direction of turn of the machine. For instance, when the machine turns in a certain predefined direction (e.g., a 90-degree right turn relative to its forward direction of motion), as a result of the frictional contact of the squeegee blades 504, 506 on the floor surface 120 and the squeegee assembly 500 may articulate to follow the direction of turn of the machine, while collecting water from rearward of the machine. For example, to collect water as the machine turns, the squeegee may articulate in a direction opposite to the direction of turn of the machine (e.g., as a result of frictional contact of the squeegee blades 504, 506 with the floor surface). Thus, if the machine makes a 90 degree turn relative to the forward direction, the squeegee assembly 500 may move leftward relative to the forward direction. Such a motion of the squeegee assembly 500 may be cooperatively accomplished by the uniform downforce acting on the squeegee blades 504, 506, and/or vacuum between the squeegee blades 504, 506, which acts to keep the squeegee blades 504, 506 pressed against the floor surface 120 while the machine turns, and/or the motion of the caster 660 and/or end wheels.

Embodiments of the present disclosure provide an interchangeable squeegee assembly that can articulate when the machine turns to effectively pick up water during wet maintenance operations such as scrubbing. The articulating mechanism according to the present disclosure may be interchangeably used with maintenance tools (e.g., scrub brushes) of different size, and may attach to exterior components of maintenance head assemblies to permit easy removal for servicing and/or replacement.

Figure 19:
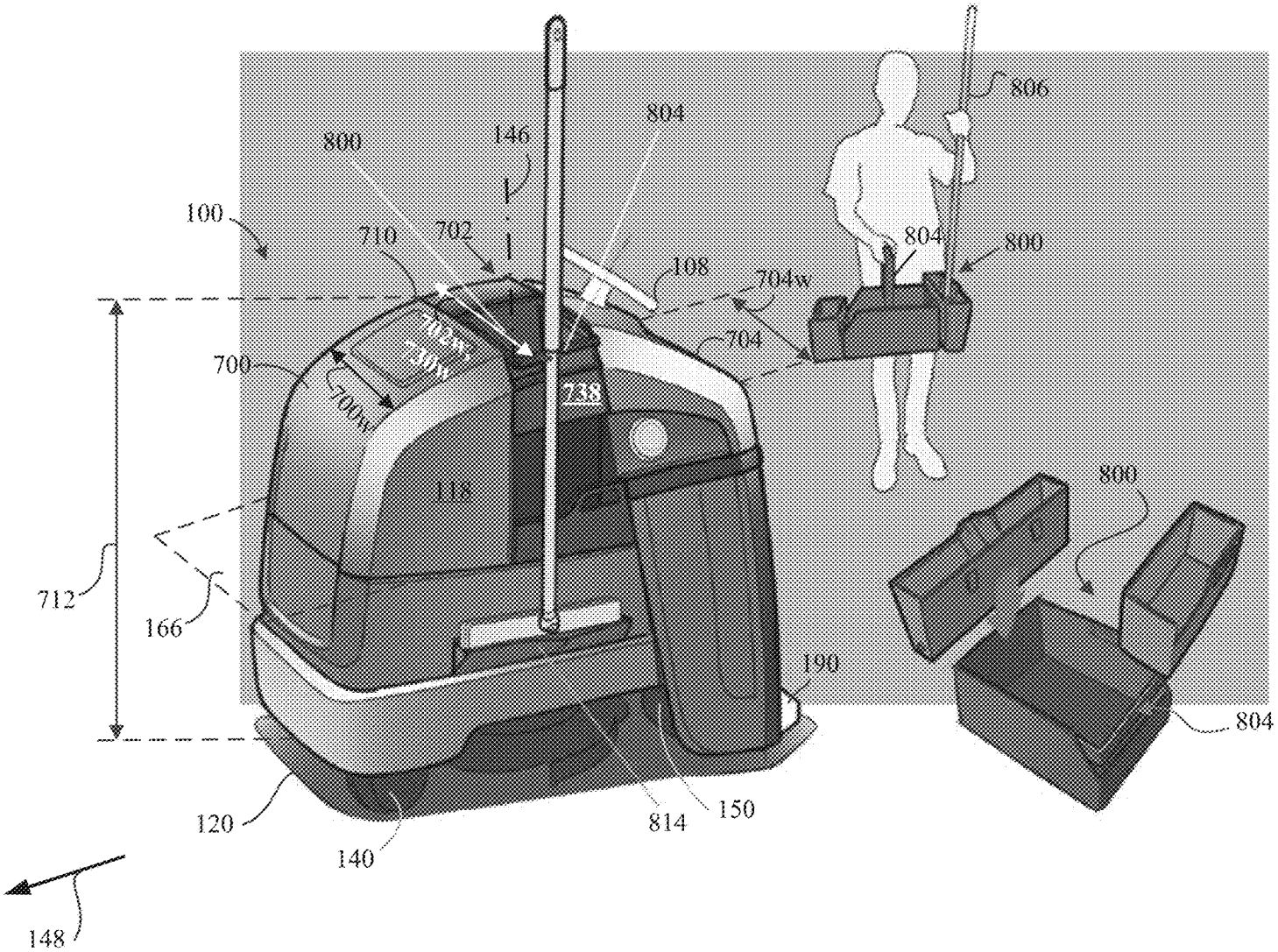
FIG. 19 is a perspective view of the surface maintenance machine of FIG. 1 illustrated with an operator and manual maintenance tools.

FIGS. 19-22 illustrate portions of the surface maintenance machine with several of the external body panels not shown in FIGS. 1-5. As illustrated, the body panels, when added, define a storage area for storing a variety of tools and supplies 740 as will be described further below. With reference to FIG. 19, the mobile body of the surface maintenance machine includes a forward section 700, a middle section 702 and a rearward section 704. The terms "forward", "rearward" and "middle section 702" are referenced with respect to the direction of travel 148 of the machine and the transverse centerline 146 of the machine. For instance, as illustrated, the forward section 700 is positioned to the front of the transverse centerline 146 of the machine, the middle section 702 is generally centered on the transverse centerline 146 and the rearward section 704 is positioned to the rear of the transverse centerline 146, when the machine moves in the direction 148.

Figure 20:
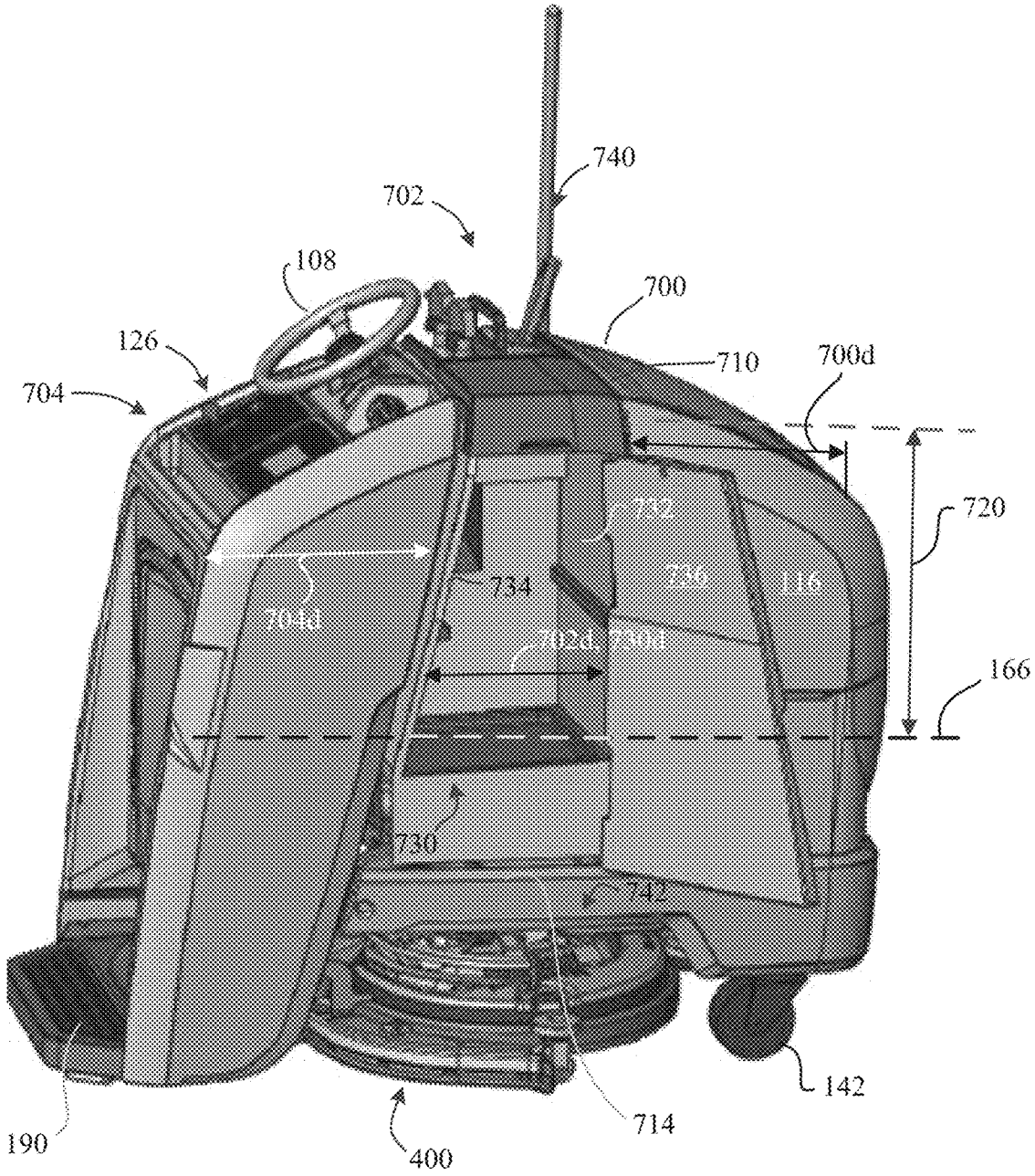
FIG. 20 is a side perspective view of the surface maintenance machine of FIG. 1 with an access door shown in an open position to illustrate interior storage areas.

With continued reference to FIG. 19, and referring now to FIG. 20, the forward section 700 extends over a forward section depth 700*d*, the middle section 702 extends over a middle section depth 702*d*, and the rearward section 704 extends over a rearward section depth 704*d*. As is apparent, each of the forward section depth 700*d*, the middle section depth 702*d*, and the rearward section depth 704*d* can be defined in a direction parallel to the direction of travel 148 of the machine. Further, the forward section 700 can extend over a forward section width 700*w*, the middle section 702 extends over a middle section width 702*w*, and the rearward section 704 extends over a rearward section width 704*w*. In this case, each of the forward section width 700*w*, middle section width 702*w* and the rearward section width 704*w* can be defined in a direction perpendicular to the direction of travel 148 and/or between lateral walls 116, 118 of the machine.

The machine can have overall dimensions configured such that at least two of the forward section depth 700*d*, the middle section depth 702*d*, and the rearward section depth 704*d* are equal. Further, at least two of the forward section width 700*w*, the middle section width 702*w*, and the rearward section width 704*w* can be equal. In some examples, the forward section 700 and the rearward section 704 can have generally equal dimensions. Further, the forward section 700, the middle section 702 and the rearward section 704 can all be substantially of the same dimensions.

Figure 21:
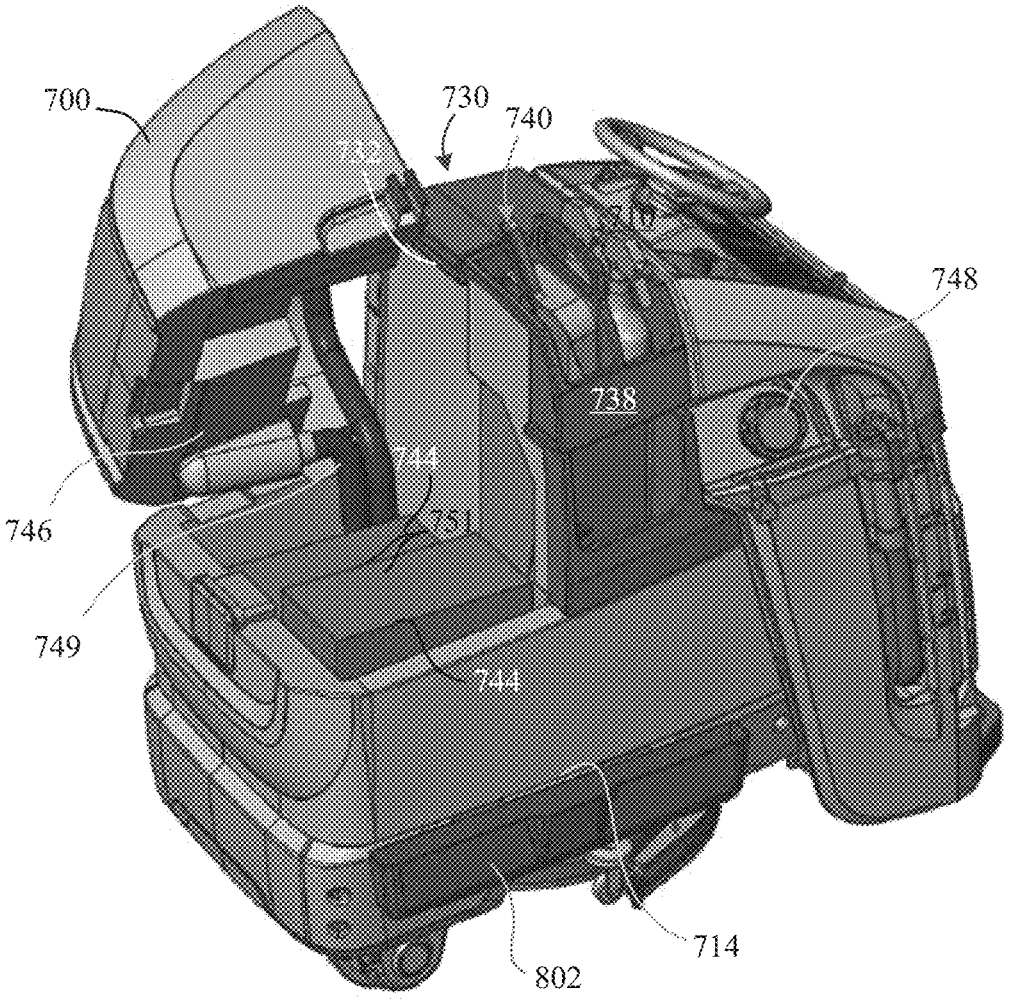
FIG. 21 is another side perspective view of the surface maintenance machine of FIG. 1 with top and front portions of the machine body shown in an open position to illustrate interior portions thereof.

With reference to FIG. 20 and referring now to FIG. 21, body panels of the machine may define the boundaries of the storage area so as to isolate it from various components of the machine such as batteries 744, solution and/or recovery tanks, sweep chamber and/or hopper, maintenance tools, and the like. For instance, the body may have a center plane 166 parallel to the floor surface and a generally planar top surface 710 positioned above the center plane 166 of the body and generally parallel thereto. The generally planar top surface 710 can be at a first distance 712 above the floor surface. Further, the body can have a generally planar lower surface 714 positioned below the center plane 166 of the body and generally parallel thereto. The generally planar lower surface 714 can be located at a second distance 720 below the generally planar top surface 710.

With continued reference to FIGS. 20 and 21, the body panels may further include boundaries that define a storage chamber 730. For instance, the body panels may include a front wall 732, a rear wall 734, lateral walls 736, 738, such that the storage chamber 730 is generally isolated from components of the surface maintenance machine and generally hollow to permit storage of maintenance tools and/or supplies 740. As mentioned previously, "front", "rear" and "lateral" refer to the position and orientation with respect to the direction of travel 148 and/or transverse centerline 146. As seen in FIGS. 20 and 21, the front wall 732 of the storage chamber 730 abuts the forward section 700 and the rear wall 734 of the storage chamber 730 abuts the rearward section 704. For instance, the front wall 732 can be a common boundary between the forward section 700 and the middle section 702. Likewise, the rear wall 734 can be a common boundary between the middle section 702 and rearward section 704. As seen in FIGS. 20 and 21, the storage chamber 730 extends over a depth 730*d* (defined between its lateral walls 736, 738) substantially equal to the middle section depth 702*d* and over a width 730*w* substantially equal to the middle section width 702*w*.

Referring back to FIG. 20, the generally planar top surface 710 can be located at a first distance 712 from the floor surface whereby, the first distance 712 corresponds to the machine height. In such cases, the storage chamber 730 can extend between the generally planar top surface 710 and the generally planar lower surface 714 of the machine body wherein the generally planar lower surface 714 is at a second distance 720 below the generally planar top surface 710, such that the second distance 720 generally corresponds to the height of the storage chamber 730. In some such cases, the second distance 720 is greater than about two-thirds of the first distance 712. In such cases, the storage chamber 730 may extend over a height of about two-thirds the height of the machine.

Referring again to FIG. 21, the boundaries of the storage chamber 730 facilitate substantially isolating the storage chamber 730 from components of the machine. For instance, the storage chamber 730 can be fluidly isolated from a maintenance chamber 742 that houses one or more maintenance tools. Further, as seen in FIG. 21, components of the machine can be re-arranged so as to permit a substantially hollow middle section 702 for defining the storage chamber 730. For instance, components of the machine such as batteries 744 for propelling the machine, and/or recovery tank 746 for collecting fluids from the floor surface, can be substantially located in the forward section 700. Further, solution tank for supplying a fluid toward a floor surface may be positioned outside the middle section 702. In the illustrated embodiment, for instance, the solution tank is defined peripherally around the body of the vehicle, with an inlet port 748 positioned in the rearward section 704.

With continued reference to FIG. 21, and as indicated above, components of the machine (e.g., such as batteries 744, maintenance head assemblies, solution tanks, vacuum systems, machine controls and the like), can be arranged to create a substantially hollow portion having a volume sufficient to house the storage chamber 730. As shown in FIG. 21, in one example, the entirety of the batteries 744 and the recovery tank 746 can be respectively located in the forward section 700, though, portions of the recovery hose 749 may pass around the storage chamber 730. Continuing with the example illustrated in FIG. 21, a storage chamber bottom surface 747 can be coplanar with or below a top surface 751 of at least one battery positioned in the forward section 700. Such embodiments permit an adequate volume of storage chamber 730 to store a variety of maintenance tools and/or supplies 740.

Figure 22:
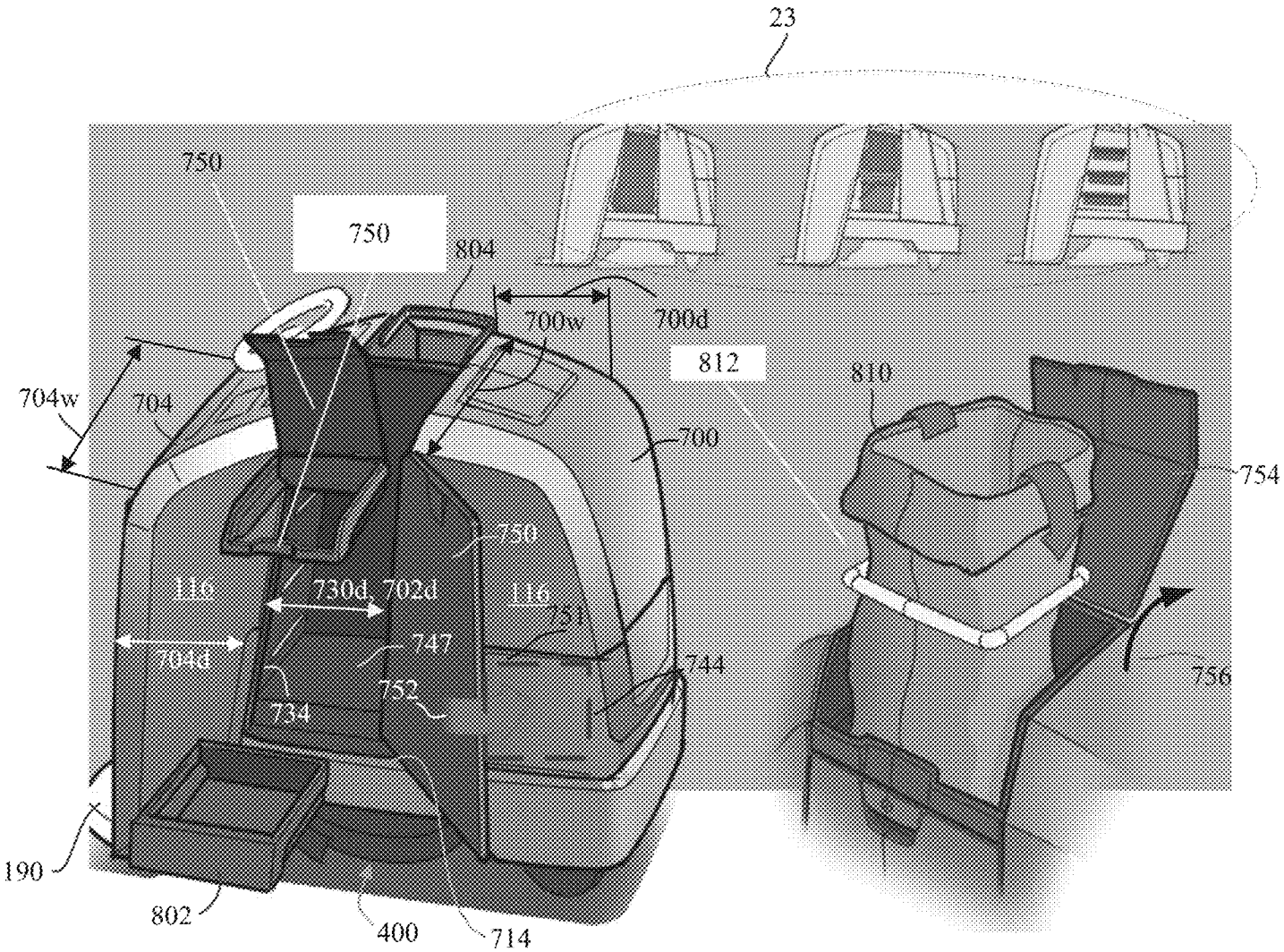
FIG. 22 is another side perspective view of the surface maintenance machine of FIG. 1 shown with two access doors.

Referring now to FIG. 22, the storage chamber 730 comprises one or more access doors for permitting access to the storage chamber 730 when opened. In the illustrated embodiment, the storage chamber 730 comprises a first access door 750 configured to open in a lateral direction 752. The first access door 750 can be formed by at least portions of a lateral wall of the storage chamber 730. Further, the first access door 750 (and in turn, the lateral walls 736, 738 of the storage chamber 730) can be generally coplanar with lateral walls 116, 118 of the machine, such that the storage chamber 730 is generally confined within the lateral extents of the machine and does not protrude outside of the machine envelope. With continued reference to FIG. 22, the storage chamber 730 comprises a second access door 754 configured to open in a direction 756 perpendicular to the direction of opening 752 of the first access door 750. Additionally, either, or both of the first access door 750 and the second access door 754 may be accessible from the operator platform such that the operator may access them (e.g., grasp and/or open). As is apparent from FIGS. 19-22, the second access door 754 is generally coplanar with the generally planar top surface 710 such that the storage chamber 730 can remain confined within a machine envelope. In such cases, the lateral walls 116, 118 of the machine and the generally planar top surface 710 may constitute at least portions of the outer boundaries of the envelope.

Referring back to FIG. 19, the storage chamber 730 defined in the middle section 702 of the machine body for storing surface maintenance tools and supplies 740 that an operator may use for performing one or more manual surface maintenance tasks. For instance, the operator may remove the surface maintenance tools and/or supplies 740, such as spray bottles housed in a caddy 800 with a one or more bins 804, brooms and/or mops 806, wash cloths, and the like and transport them manually to a location where a manual maintenance operation is to be performed. Referring now to FIG. 21, the storage chamber 730 may also be configured to store debris collected from the manual maintenance, for instance, in a trash bag 810, that may be positioned in the storage chamber 730 (e.g., using frame elements 812).

Figures 23A, 23B, 23C:
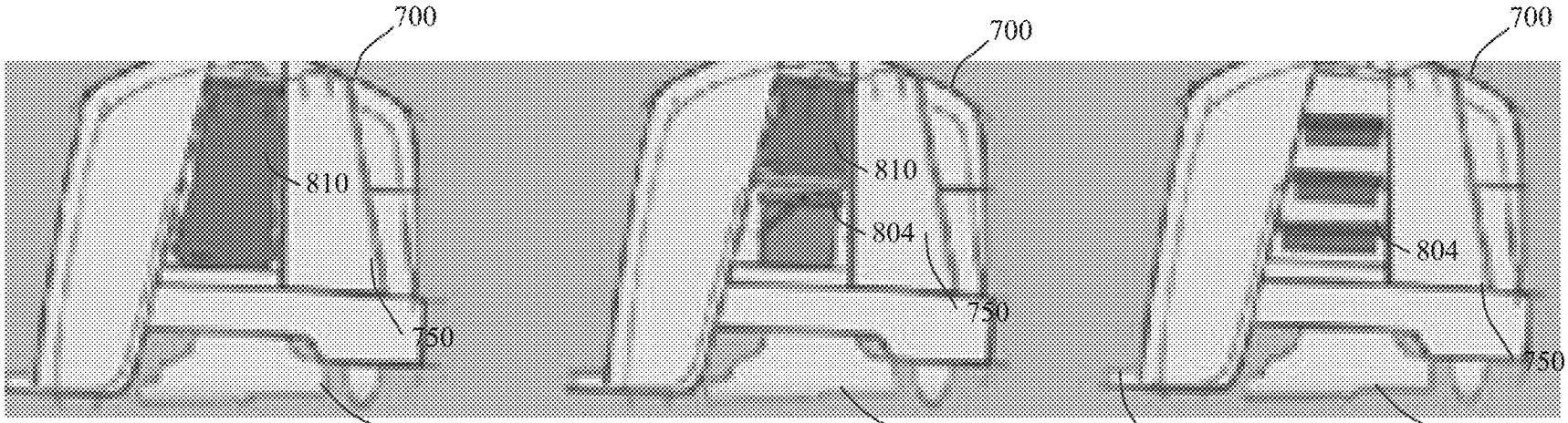
FIGS. 23A, 23B and 23C are schematics illustrating a modular storage chamber positioned within the body of the surface maintenance machine.

As seen in FIG. 22 and referring to the enlarged portions thereof illustrated in FIGS. 23A-23C, the storage chamber 730 can be of a modular design so as to facilitate housing individual storage modules such as a storage caddy 800, one or more storage bins 804, a drip catching bin for storing/collecting fluids from a mop, a debris compartment and the like. For instance, in FIG. 23A, the storage chamber 730 is illustrated as having a trash bag 810 housed therewithin, whereby the trash bag 810 extends substantially over the height of the storage chamber 730. FIG. 23B illustrates another use of the storage chamber 730, whereby the trash bag 810 extends over one half of the height of the storage chamber 730, and a storage bin is placed in the remaining space. FIG. 23C illustrates a further use of the storage chamber 730, wherein a plurality of bins 804/trays can be placed in the space within the storage chamber 730 instead of a trash bag 810. Any such modular arrangements are contemplated within the scope of the present disclosure.

Embodiments of the surface maintenance machine with storage areas such as those illustrated herein permit an operator to store tools and supplies 740 for performing manual surface maintenance operations in situations where the machine may not be able to travel (e.g., areas with aisle widths narrower than the width of the machine) for collecting large dry debris or for off-the-floor manual maintenance.

Various examples have been described. These and other examples are within the scope of this disclosure.

The invention claimed is:

1. A surface maintenance machine, comprising:

a body having a forward section, a middle section and a rearward section, wherein the forward section is positioned to the front of a transverse centerline of the machine, the middle section is generally centered on the transverse centerline and a rearward section positioned to the rear of the transverse centerline, the body having a center plane parallel to a floor surface on which the machine travels;

a generally planar top surface positioned above the center plane of the body and generally parallel thereto, the generally planar top surface being located at a first distance above the floor surface, the first distance corresponding to a machine height;

a generally planar lower surface positioned below the center plane of the body and generally parallel thereto, the generally planar lower surface being located at a second distance below the generally planar top surface;

a storage chamber defined in the middle section and enclosed by a front wall, a rear wall, lateral walls, the generally planar top surface, and the generally planar lower surface, such that the storage chamber is generally isolated from components of the surface maintenance machine, wherein the storage chamber includes an access door formed by at least a portion of one of the lateral walls, the access door configured to permit access to the storage chamber when opened, the front wall of the storage chamber abutting the forward section and the rear wall of the storage chamber abutting the rearward section, the storage chamber being generally hollow and being configured to store one or more surface maintenance tools and/or supplies;

two front wheels positioned to the front of a transverse centerline of the machine when the machine is moving in a forward direction; and at least one rear wheel positioned to the rear of the transverse centerline.

2. The surface maintenance machine of claim 1, further comprising one or more maintenance tools housed in a maintenance chamber, the one or more surface maintenance tools being configured for performing a surface maintenance operation, wherein the storage chamber being fluidly isolated from the maintenance chamber.

3. The surface maintenance machine of claim 2, wherein the generally planar lower surface forms an upper boundary of the maintenance chamber.

4. The surface maintenance machine of claim 1, further comprising one or more batteries for propelling the machine, the batteries being positioned substantially in the forward section.

5. The surface maintenance machine of claim 4, further comprising a solution tank for supplying a fluid toward a floor surface and a recovery tank for collecting fluids from the floor surface, at least one of the solution tank and the recovery tank being substantially located in the forward section.

6. The surface maintenance machine of claim 5, wherein the entirety of the batteries and the recovery tank being respectively located in the forward section.

7. The surface maintenance machine of claim 1, wherein the second distance is greater than about two-thirds of the first distance.

8. The surface maintenance machine of claim 1, wherein lateral walls of the storage chamber are generally coplanar with lateral walls of the machine body.

9. The surface maintenance machine of claim 1, wherein the forward section extends over a forward section depth, the middle section extends over a middle section depth, and the rearward section extends over a rearward section depth, each of the forward section depth, the middle section depth, and the rearward section depth being defined in a direction parallel to the direction of travel of the machine.

10. The surface maintenance machine of claim 9, wherein at least two of the forward section depth, the middle section depth, and the rearward section depth are equal.

11. The surface maintenance machine of claim 9, wherein the storage chamber extends between the lateral walls thereof over a depth substantially equal to the middle section depth.

12. The surface maintenance machine of claim 9, wherein the forward section extends over a forward section width, the middle section extends over a middle section width, and the rearward section extends over a rearward section width, each of the forward section depth, the middle section depth, and the rearward section depth being defined between lateral walls of the surface maintenance machine, at least two of the forward section width, the middle section width, and the rearward section width being equal, and wherein the storage chamber extends over a storage chamber width substantially equal to the middle section width.

13. A surface maintenance machine comprising:

a body having a forward section, a middle section and a rearward section, wherein the forward section is positioned to the front of a transverse centerline of the machine, the middle section is generally centered on the transverse centerline and a rearward section positioned to the rear of the transverse centerline, the body having a center plane parallel to a floor surface on which the machine travels;

a generally planar top surface positioned above the center plane of the body and generally parallel thereto, the generally planar top surface being located at a first distance above the floor surface, the first distance corresponding to a machine height;

a generally planar lower surface positioned below the center plane of the body and generally parallel thereto, the generally planar lower surface being located at a second distance below the generally planar top surface;

a storage chamber defined in the middle section and enclosed by a front wall, a rear wall, lateral walls, the generally planar top surface, and the generally planar lower surface, such that the storage chamber is generally isolated from components of the surface maintenance machine, wherein the storage chamber comprises a first access door configured to open in a lateral direction and permit access to the storage chamber when opened and;

the front wall of the storage chamber abutting the forward section and the rear wall of the storage chamber abutting the rearward section, the storage chamber being generally hollow and being configured to store one or more surface maintenance tools and/or supplies;

two front wheels positioned to the front of a transverse centerline of the machine when the machine is moving in a forward direction; and at least one rear wheel positioned to the rear of the transverse centerline.

14. The surface maintenance machine of claim 13, wherein the first access door is formed by at least portions of a lateral wall of the storage chamber.

15. The surface maintenance machine of claim 13, wherein the storage chamber comprises a second access door configured to open in a direction perpendicular to the direction of opening of the first access door.

16. The surface maintenance machine of claim 15, wherein the second access door is generally coplanar with the generally planar top surface.

17. The surface maintenance machine of claim 15, wherein the storage chamber being configured to remain confined with a machine envelope.

18. The surface maintenance machine of claim 13, further comprising an operator platform located on the rearward section, the operator platform being configured to permit an operator to stand thereon, the first access door being situated at a lateral distance from the operator platform so as to be accessible by an operator when standing on the operator platform.

19. A surface maintenance machine, comprising:

a body having a forward section, a middle section and a rearward section, wherein the forward section is positioned to the front of a transverse centerline of the machine, the middle section is generally centered on the transverse centerline and a rearward section positioned to the rear of the transverse centerline;

one or more batteries for propelling and/or providing on-board power to the machine, the one or more batteries being positioned in the forward section;

a solution tank for supplying a cleaning solution to a floor surface on which the machine travels;

a recovery tank for collecting waste from a floor surface on which the machine travels;

a storage chamber defined in the middle section and enclosed between the forward section and the rearward section, the storage chamber being defined between one of the one or more batteries and the solution tank, the storage chamber being generally hollow and being configured to store one or more surface maintenance tools and/or supplies, the storage chamber having a storage chamber bottom surface, the storage chamber bottom surface being coplanar with or below a top surface of at least one battery positioned in the forward section;

two front wheels positioned to the front of a transverse centerline of the machine when the machine is moving in a forward direction; and at least one a rear wheel positioned to the rear of the transverse centerline.

20. The surface maintenance machine of claim 19, wherein at least one of the front wheels is steerable, the surface maintenance machine further comprising a motive source for providing motive force to at least one front wheel to drive the machine on a surface, the motive source being coupled to the at least one steerable front wheel.

21. The surface maintenance machine of claim 19, wherein the rear wheel is positioned centrally along a longitudinal centerline of the machine, and the front wheels are positioned symmetrically about opposite side of the longitudinal centerline of the machine.

22. The surface maintenance machine of claim 19, wherein the storage chamber is fluidly isolated from the solution tank.

* * * * *